US005408379A

United States Patent [19]

Oguchi et al.

[11] Patent Number: 5,408,379

[45] Date of Patent: Apr. 18, 1995

[54] DEVICE FOR OPENING A CIRCUIT AND DEVICE FOR PROTECTING THE CIRCUIT AGAINST SURGES

[75] Inventors: Yoshihito Oguchi; Akihiko Ikazaki, both of Tokyo; Yoshiro Suzuki, Hanyu; Kazuomi Hama; Mitsuo Yaguchi, both of Okaya; Yoshito Kasai, Kumagaya; Toshio Uchida, Hasuda, all of Japan

[73] Assignee: Okaya Electric Industries Co., Ltd., Tokyo, Japan

[21] Appl. No.: 940,976

[22] Filed: Sep. 4, 1992

[30] Foreign Application Priority Data

Sep. 9, 1991 [JP] Japan ..... 3-258470
Sep. 9, 1991 [JP] Japan ..... 3-258471
Sep. 9, 1991 [JP] Japan ..... 3-258472

[51] Int. Cl.[6] ..... H01H 85/04

[52] U.S. Cl. ..... 361/55; 361/103; 361/119; 361/679; 338/309; 338/204; 338/287

[58] Field of Search ..... 361/55, 103, 104, 119, 361/125, 679; 338/309, 204, 297; 337/28, 31, 34

[56] References Cited

U.S. PATENT DOCUMENTS 5,204,799 4/1993 Stibila ..... 361/104

*Primary Examiner*—A. D. Pellinen
*Assistant Examiner*—Sally Medley
*Attorney, Agent, or Firm*—Mark Catan; Thomas R. Morrison

[57] ABSTRACT

An insulating substrate has a heat generating resistor and an electrical conductor on its surface. A pair of conductors, such as power or communication leads, are connected to a protected circuit. A rated voltage element and the heat generating resistor is connected in series between the lines. The electrical conductor is connected in series between one of the lines and the protected circuit. When a continuous overvoltage greater than a rated voltage of the rated voltage element develops in the lines, the rated voltage element acts to draw excess current through it and the heat generating resistor. When this current reaches a certain point, heat from the overcurrent in the heat generating resistor ruptures the substrate and the electrical conductor so that both the rated voltage element and the circuit are isolated from the conductors. This protects the protected circuit from destruction of, and consequent loss of protection by, the rated voltage element. It also protects the rated voltage element itself by isolating it from the overvoltage.

6 Claims, 32 Drawing Sheets

DEVICE FOR OPENING A CIRCUIT AND DEVICE FOR PROTECTING THE CIRCUIT AGAINST SURGES

BACKGROUND OF THE INVENTION

1. Field of the Invention

This invention relates to a device for opening a circuit, which is connected to a protective circuit comprising a constant voltage element disposed between two lines. More specifically, when an overvoltage greater than a rated voltage of the constant voltage element is continuously applied between the two lines, the device for opening the circuit opens the connection between the two lines preventing the overvoltage from being applied to a load side. Further, this invention provides an device for protecting the circuit from overvoltage, in which the device for opening the circuit and the constant voltage element are formed integrally.

2. Description of the Prior Art

In FIG. 34 there is shown a conventional protective circuit (a), in which a constant voltage element (c) such as a silicone surge absorber is disposed between two power source lines or communication lines. The protective circuit is disposed in front of an electronic circuit in an electronic apparatus in order to protect it from overvoltage such as surge or the like. As shown in FIG. 34, protective circuit (a) comprises constant voltage element (c) disposed on a line between two lines A, A' connected to an electronic circuit (b), a fuse (d) for separating the circuit connected in series to constant voltage element (c) and a line intercepting fuse (e) connected in series to line A.

When a surge is applied instantaneously to lines A, A' through an input side, it can be absorbed by constant voltage element (c). Further, when the electronic apparatus is connected by mistake to a power source whose voltage is greater than the rated voltage, or a communication line is connected by mistake to the power source, or the overvoltage greater than rated voltage of constant voltage element (c) is applied;: continuously to lines A, A', fuse (d) is fused to prevent a short-cut destruction or burning of constant voltage element (c), thereby constant voltage element (c) is separated from line A'. Further, after constant voltage element (c) has been separated therefrom, there is the possibility that electronic circuit (b) may be destroyed since overvoltage is applied to it continuously. Therefore, fuse (d) is fused to intercept line A, so that protective circuit (a) itself is opened.

In order to protect electronic circuit (b) from overvoltage, fuse (d) as well as fuse (e) must be fused certainly. A fusing property of a fuse depends greatly on a current amount, a current applying time or the like. Accordingly, there occurs a slight time gap between the time when fuse (d) fuses and the time when fuse (e) fuses. During the foregoing slight time gap, there is a danger that the overvoltage applied to electronic circuit (b) may destroy it.

OBJECTS AND SUMMARY OF THE INVENTION

It is an object of the present invention to provide a device for opening a circuit and a device for protecting the circuit against surges which overcomes the drawbacks of the prior art.

To achieve the above object, the present invention includes: an insulating substrate; a heat generating resistant body; an electric conductive body; the heat generating resistant body formed on the insulating substrate; the heat generating resistant body connected in series to a rated voltage element; the rated voltage element connected to two lines; the two lines constructed as power resource lines or communication lines; the electric conductive body formed on the insulating substrate; the electric conductive body connected in series to the two lines; means for opening a circuit when an overvoltage more than a rated voltage of the rated voltage element gets into the lines; the means for opening the circuit including means for cutting off the lines; and the means for cutting the lines including means for breaking off the heat generating resistant body and the electric conductive body due to the heat generating resistant body heating by an overcurrent from the overvoltage.

Also, the electric conductive body can be formed by a fuse material.

Furthermore, the device for protecting a circuit of the present invention comprising: a device for opening a circuit; the device for opening the circuit having a heat generating resistant body and an electric conductive body attached on an insulating substrate; the device for opening the circuit connected to two lines; a rated voltage element; the rated voltage element connected in series to the heat generating resistant body; the rated voltage element connected to the two lines; the two lines constructed for power resource or communication; the electric conductive body connected in series to the two lines; means for protecting a circuit when an overvoltage more than a rated voltage of the rated voltage element gets into the lines; the means for protecting the circuit including means for opening the circuit; the means for opening the circuit including means for cutting off the lines; and the means for cutting the lines including means for breaking off the heat generating resistant body and the electric conductive body due to the heat generating resistant body heating by an overcurrent from the overvoltage.

In the above, the rated voltage element is preferably formed by silicon surge absorber. Zener diode, a varistor or a gasarrester can be applied.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
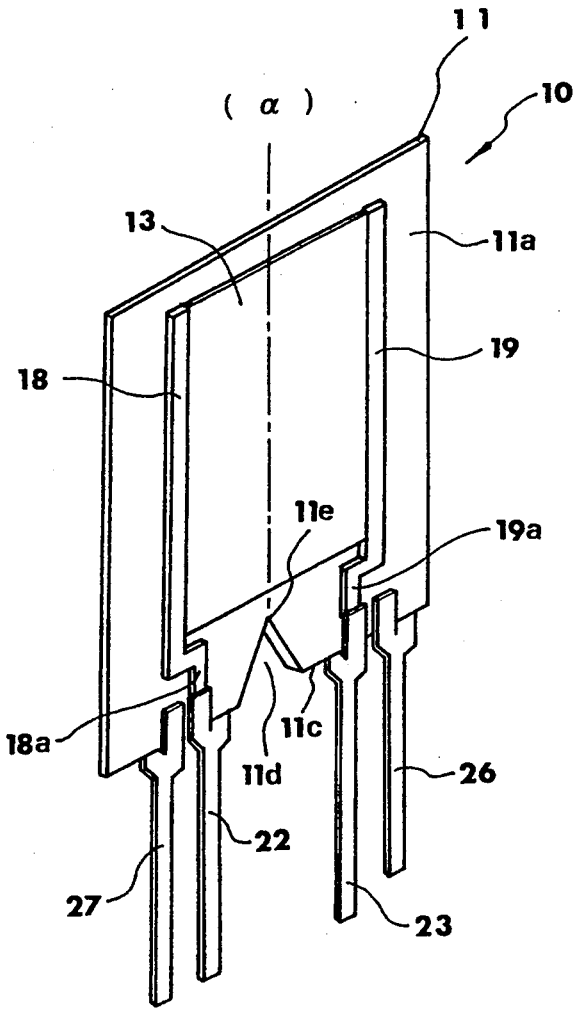
FIG. 1 is a perspective view showing a front side of a first circuit opening device according to this invention.
Figure 2:
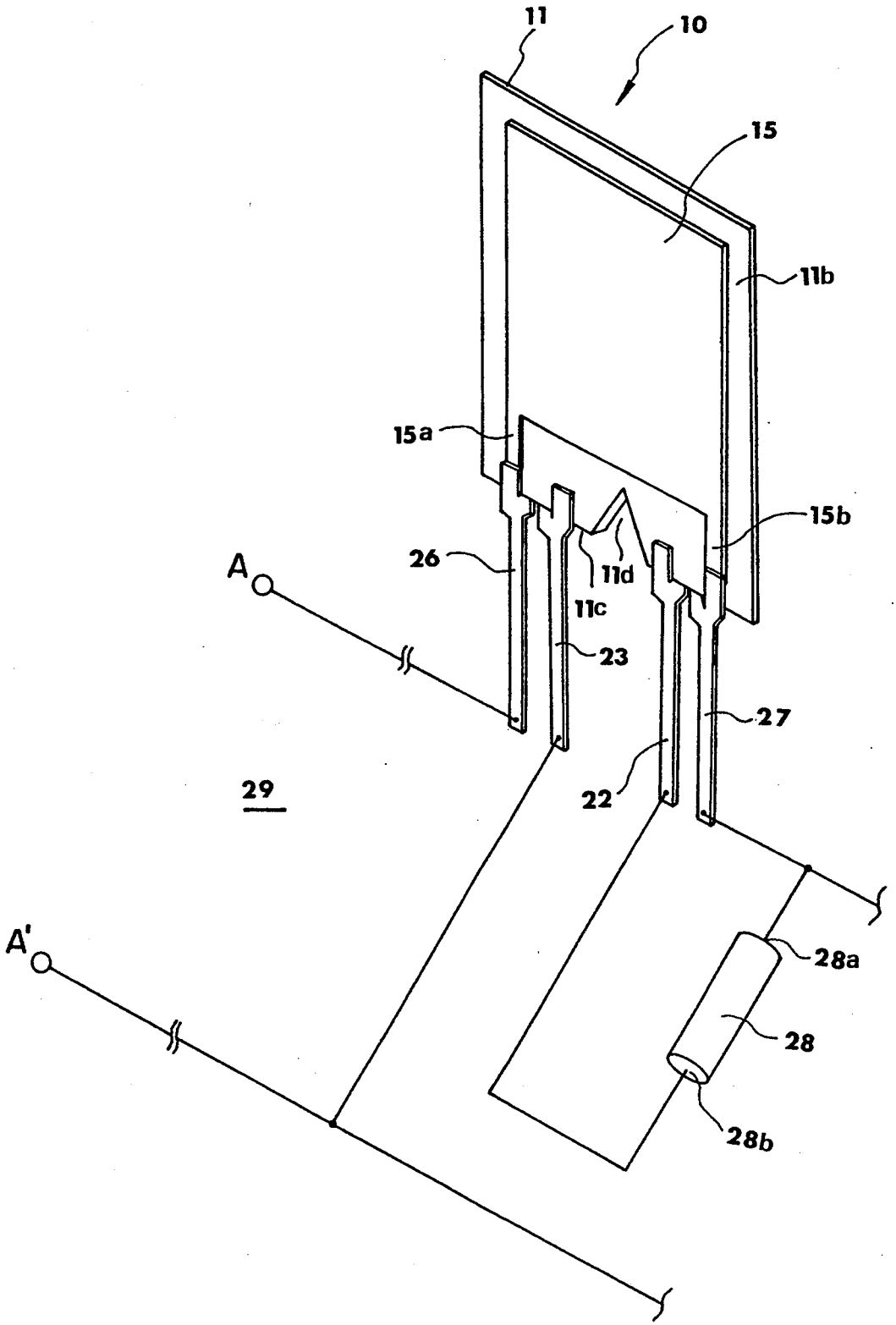
FIG. 2 is a perspective view showing a rear side of the first circuit opening device.
Figure 3:
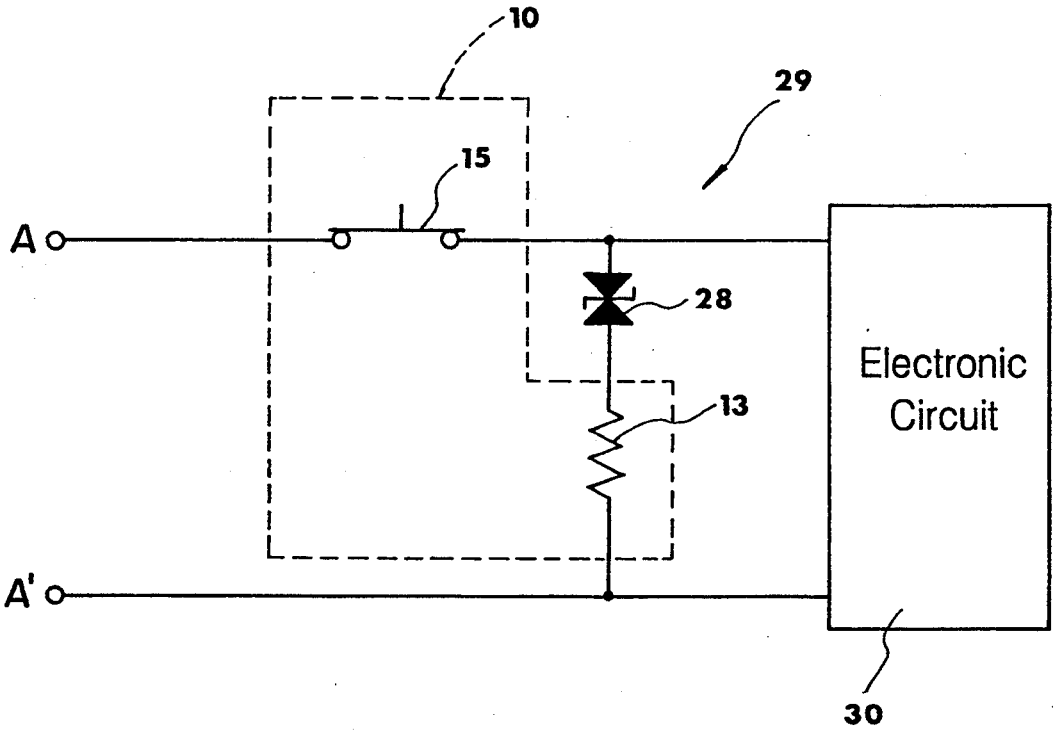
FIG. 3 is a circuit of the first circuit opening device.

Referring first to FIGS. 1 and 2, and 3, a first circuit opening device 10 according to this invention comprises a first insulating: substrate 11, a first heat generating resistant film 13 formed on a front side 11*a* of first insulating substrate 11 and a first electrically conductive film 15 formed on a rear side 11*b*. First insulating substrate 11 made from ceramics such as an alumina, a forsterite, a steatite or the like has a thickness of 0.5 to 1.5 mm. There is a triangle shaped cutout, 11*d*, in the center of the bottom of first insulating substrate 11. First heat generating resistant film 13 made from, for example, ruthenium paste or the like, has a thickness of 10 to 25 μm. First electrically conductive film 15 made from a good electric conductor such as a silver-palladium paste has a thickness of 10 to 25 μm.

A first electrode pattern 18 and a second electrode pattern 19 are connected to the right side and the left side of first heat generating resistant film 13. A first terminal connecting portion 18*a* and a second terminal connecting portion 19*a* are formed at the lower of first electrode pattern 18 and second electrode pattern 19 respectively. Moreover, a first terminal 22 and a second terminal 23 are connected to first terminal connecting portion 18*a* and second terminal connecting portion 19*a* respectively by soldering or the like. There are a first extension 15*a* connected to a third terminal 26 by soldering or the like at the left bottom and a second extension 15*b* connected to a fourth terminal 27 by soldering or the like at the right bottom.

First circuit opening device 10 is connected to a security circuit 29 having a silicon surge absorber 28 as a rated voltage element between a line A and a line A′ which could be a power line or a communication line. Namely, Third terminal 26 and fourth terminal 27 are connected to line A and first terminal 22 is connected to a bottom end 28*b* of silicon surge absorber 28 whose upper end 28*a* is connected to line A. Also, second terminal 23 is connected to line A′. Therefore, first electrically conductive film 15 is connected to line A in series as shown schematically in FIG. 3, and first heat generating resistant film 13 is connected to silicon surge absorber 28 in series between line A and line A′.

If a surge current develops in lines A, A′, silicon surge absorber 28 activates to absorb the surge current so that the surge current cannot pass through electronic circuit 30.

A continuous overvoltage condition may also develop in lines A, A′. When a continuous overvoltage greater than the rated voltage of silicon surge absorber 28 develops in lines A, A′, the overcurrent will flow through silicon surge absorber 28 continuously.

The continuous overvoltage causes first heat generating resistant film 13 to become very hot causing the front side, 11*a*, of first insulating substrate 11 to rise in temperature. First electrically conductive film 15, however, does not experience any increase in temperature despite the continuous overcurrent condition. Similarly, there is no temperature rise at the rear side, 11*b*, of first insulating substrate 11. Moreover the heat transfer to insulating substrate 11 causes it to eventually rupture along an extended line (α) through a top 11*e* of cut out 11*d*. The rupturing of insulating substrate 11 causes both first heat generating resistant film 13 and first electrically conductive film 15 to become separated from lines A′ and A, respectively thereby isolating silicon surge absorber 28 from line A′. Separating silicon surge absorber 28 from line A′ effectively opens security circuit 29 which isolates electronic circuit 30 from the source of the overvoltage.

According to the above, first heat generating resistant film 13 functions as a fuse to separate silicon surge absorber 28 from security circuit 29, and simultaneously first electrically conductive film 15 functions as a switch to open security circuit 29.

Moreover, if the surface of first heat generating resistant film 13 is coated with a deleaden glass such as borosilicate bismuth glass or the like in a thickness of 10 to 100 μm, a surface discharge can be prevented.

Figure 4:
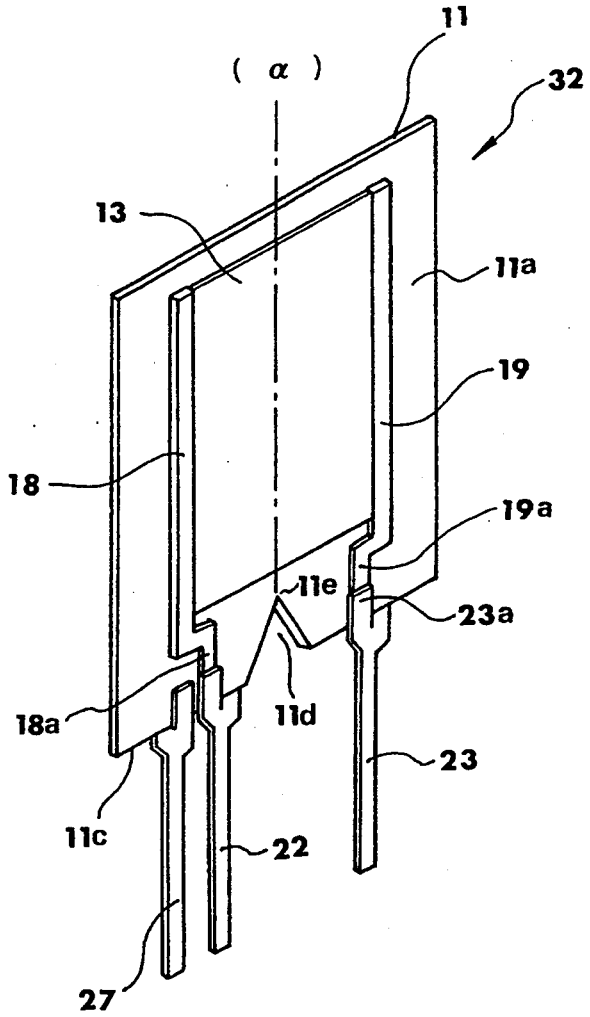
FIG. 4 is a perspective view showing a front side of a second circuit opening device.
Figure 5:
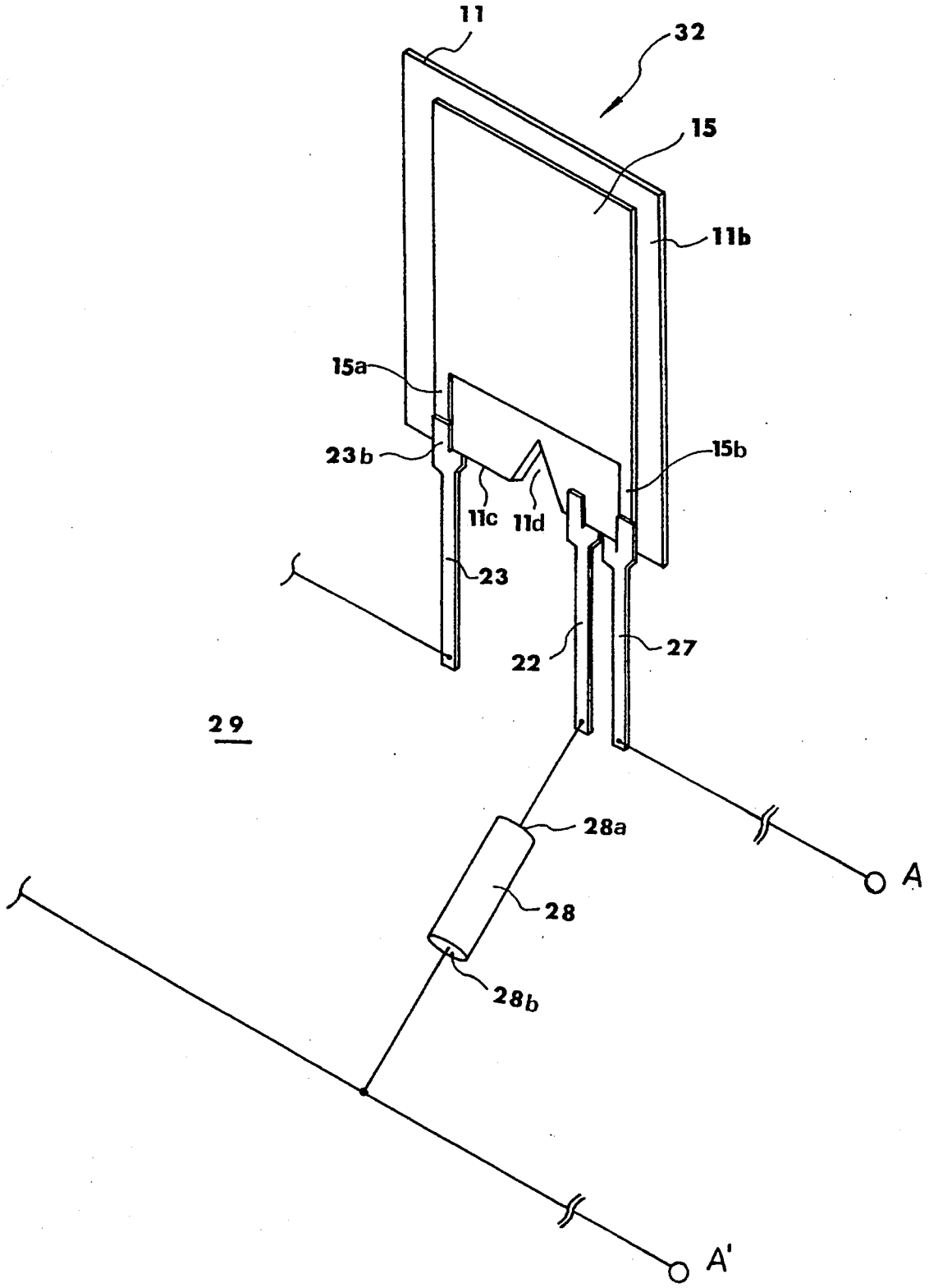
FIG. 5 is a perspective view showing a rear side of the second circuit opening device.
Figure 6:
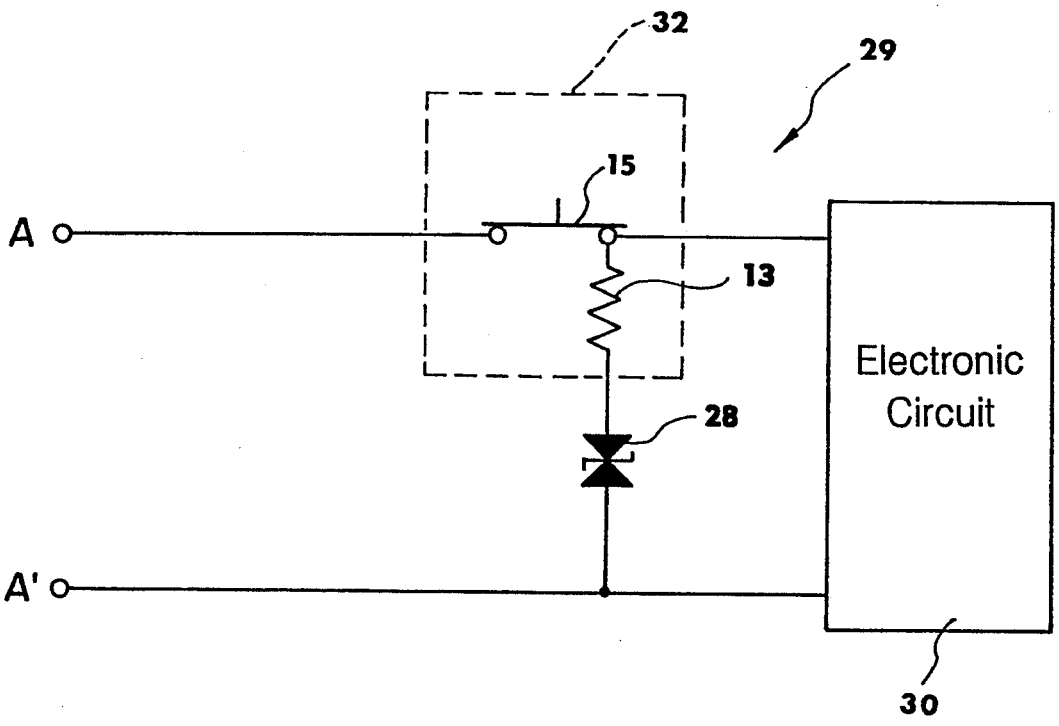
FIG. 6 is a circuit of the second circuit opening device.

Referring to FIGS. 4 and 5, and 6 the feature of a second circuit opening device 32 is that second terminal 23 also has the function of third terminal 26 in first circuit opening device 10. A first branch 23*a* of second terminal 23 is connected to second connecting portion 19*a* at front side 11*a* and also second branch 23*b* is connected to first extension 15*a* of first electrically conductive film 15.

Second circuit opening device 32 is connected to security circuit 29 having a silicon surge absorber 28 between a line A and a line A'. Second terminal 23 and fourth terminal 27 are connected to line A and also first terminal 22 is connected to a upper end 28*a* of silicon surge absorber 28 whose lower end 28*b* is connected to line A'. Therefore, first electrically conductive film 15 is connected to line A in series as shown in FIG. 6. First heat generating resistant film 13 is connected to silicon surge absorber 28 in series between line A and line A'.

Second circuit opening device 32 also has the same protection function as that of first circuit opening device 10 to the surge. Since only first terminal 22, second terminal 23 and fourth terminal 27 are used, it is possible to simplify the structure and the process for producing and attaching into a circuit.

Figure 7:
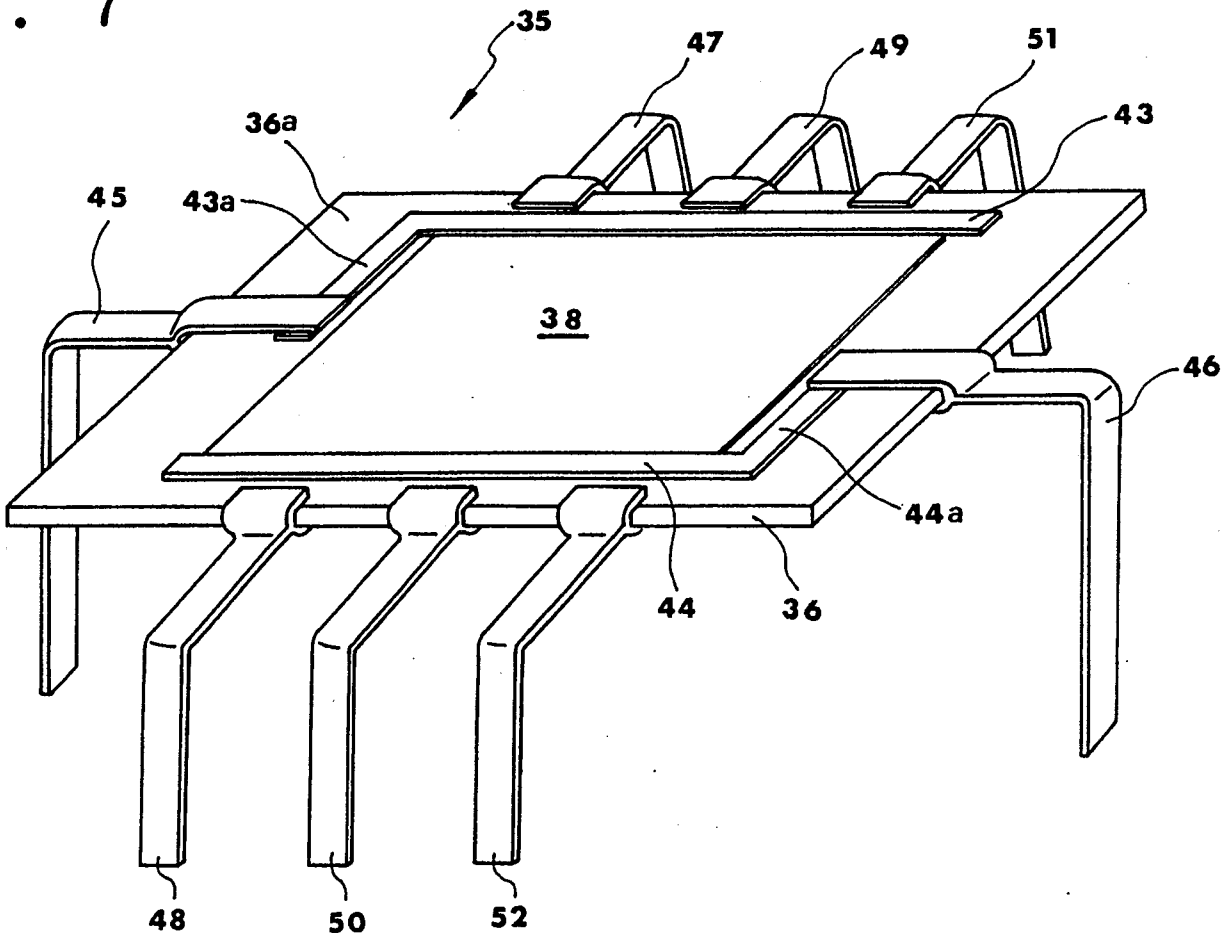
FIG. 7 is a perspective view showing a surface of a third circuit opening device.
Figure 8:
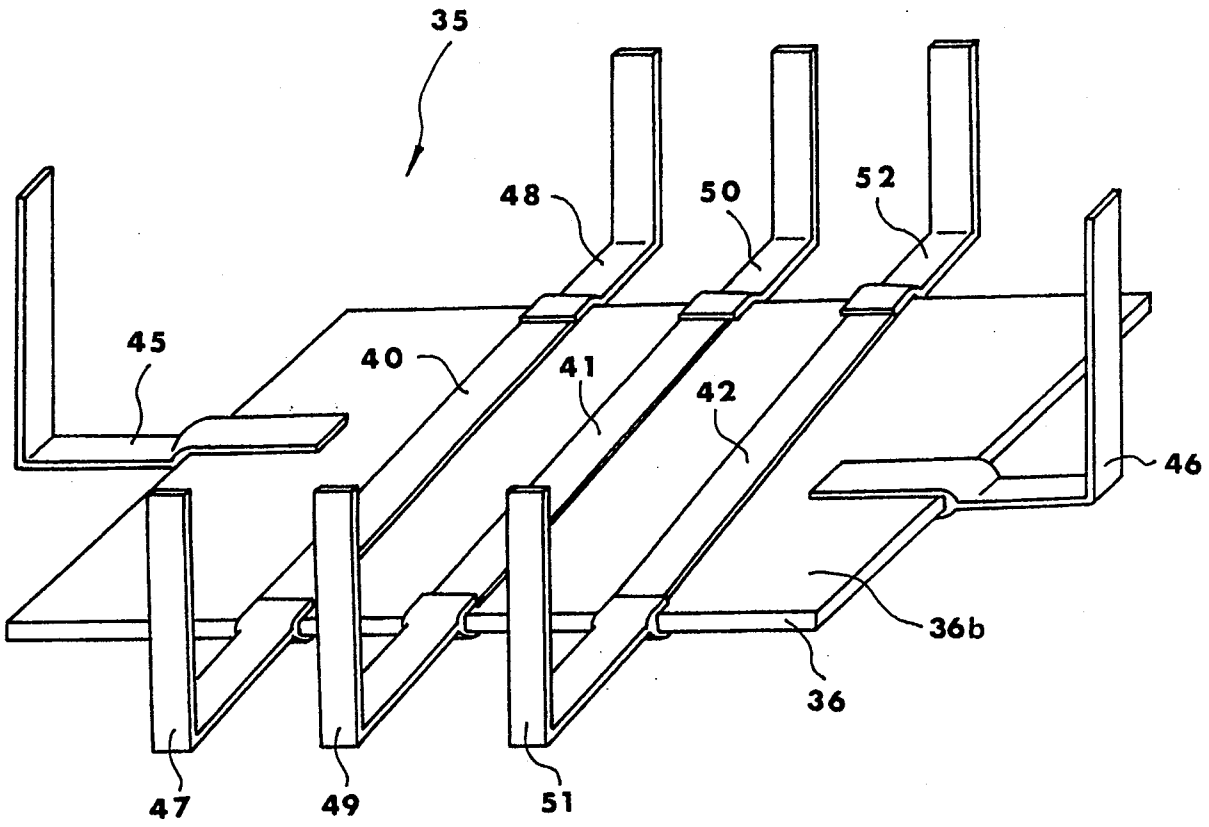
FIG. 8 is a perspective view showing a rear side of the third circuit opening device.
Figure 9:
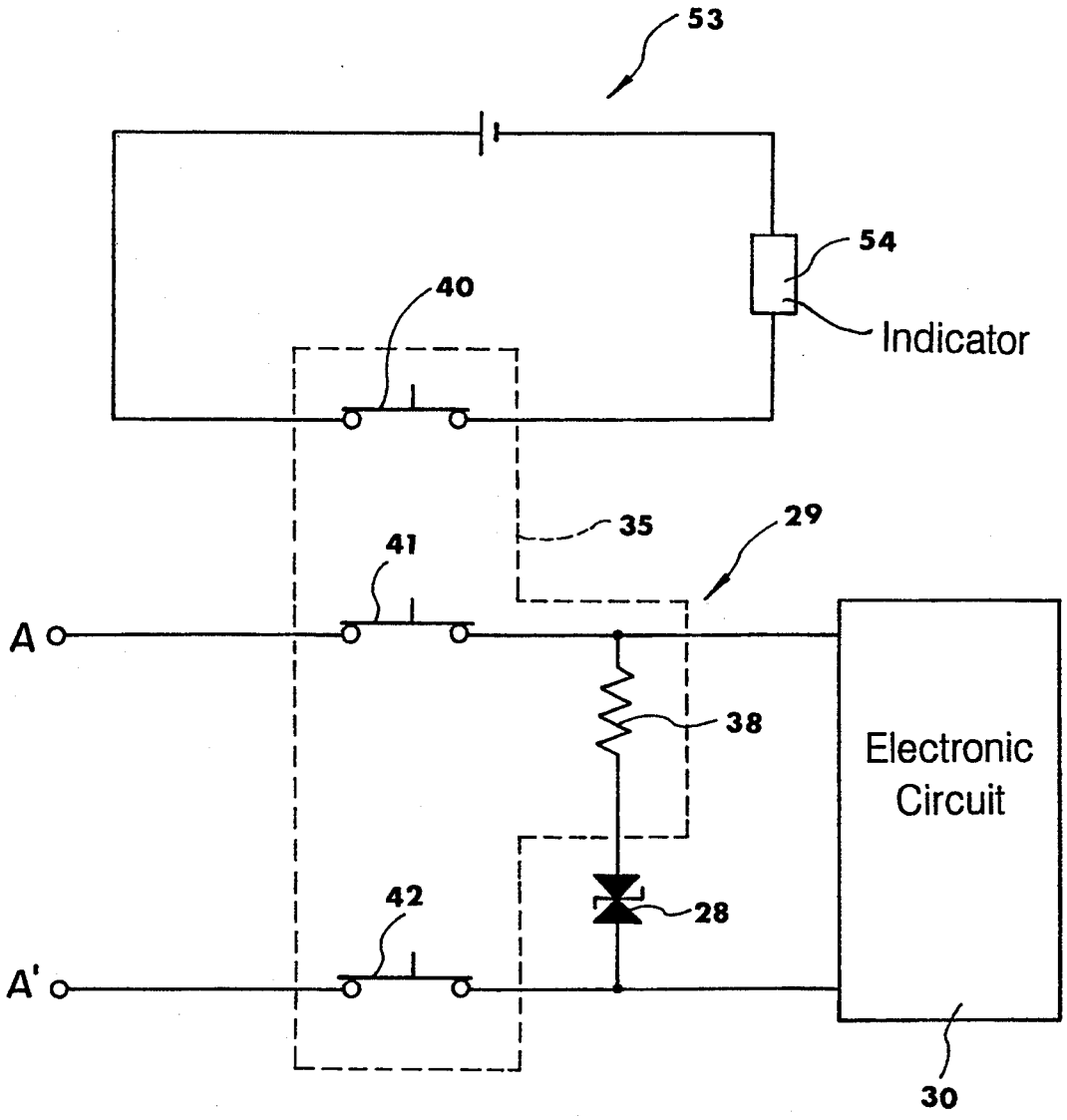
FIG. 9 is a circuit of the third circuit opening device.

Referring to FIGS. 7, 8, and 9, a third circuit opening device 35 comprises a second insulating substrate 36, a second heat generating resistant film 38 attached at a front side 36*a* of second insulating substrate 36, and first electrically conductive portion 40, second electrically conductive portion 41 and third electrically conductive portion 42 attached at a rear side 36*b* of second insulating substrate 36. Second insulating substrate 36 made from a ceramic such as an alumina, a forsterite, a steatite or the like has a thickness of 0.5 to 1.5 mm. Also, second heat generating resistant film 38 made from a ruthenium paste or the like has a thickness of 10 to 25 μm. Furthermore, first, second and third electrically conductive portions 40, 41 and 42 are made of a good electric conductor such as a silver and a palladium paste or the like and have thicknesses of 10 to 25 μm.

There are a third electrode pattern 43 and a fourth electrode pattern 44 on second heat generating resistant film 38 in a direction. A terminal connecting portion 43*a* of third electrode pattern 43 is connected to a first L type terminal 45 and also a terminal connecting portion 44*a* of fourth electrode pattern 44 is connected to a second L type terminal 46. In turn, both ends of first electrically conductive portion 40 are connected to third L type terminal 47 and fourth L type terminal 48 respectively, Both ends of second electrically conductive portion 41 are connected to fifth L type terminal 49 and sixth L type terminal 50. Both ends of third electrically conductive portion 42 are connected to seventh. L type terminal 51 and eighth L type terminal 52 respectively.

Regarding third circuit opening device 35 referring to FIG. 9, first L type terminal 45 is connected to line A, second L type terminal 46 is connected to an upper end of silicon surge absorber 28 whose lower end is connected to line A', so that second heat generating resistant film 38 is connected in series with silicon surge absorber 28 between line A and line A'. Fifth L type terminal 49 and sixth L type terminal 50 are connected to line A, so that second electrically conductive portion 41 is connected in line A in series. Furthermore, seventh L type terminal 51 and eighth L type terminal 52 are connected to line A', so that third electrically conductive portion 42 is connected to line A' in series. Finally, third L type terminal 47 and fourth L type terminal 48 are not connected to security circuit 29 but to an outside circuit 53, which is, for instance, a circuit for observing with an indicator 54.

If a surge develops in lines A, A', silicon surge absorber 28 activates to absorb the surge. However, when an overvoltage greater than the rated voltage of silicon surge absorber 28 is sustained continuously, the overcurrent flows through silicon surge absorber 28 continuously. Then, second heat generating resistant film 38 becomes very hot so that second insulating substrate 36 ruptures. The rupturing of substrate 36 causes silicon surge absorber 28 to separate from line A and conductive lines 40, 41, and 42, are broken so that security circuit 29 itself is opened. Opening security circuit 29 protects electronic circuit 30 from damage due to the continuous overvoltage.

Due to a disconnection of second electrically conductive portion 41 and third electrically conductive portion 42, line A and line A' are simultaneously severed from open security circuit 29. Moreover, since first electrically conductive portion 40 connected to outside circuit 53 is severed, outside circuit 53 is also opened. Since silicon surge absorber 28 and lines A and A' are severed simultaneously, it is possible to save electronic circuit 30 from damage with certainty. Also, it is possible to observe a system condition in real time using indicator 54 when outside circuit 53 is opened due to an opening of security circuit 29.

In the embodiment, third circuit opening device 35 has three electric conductive portions. The invention, however, can apply to a system to open outside circuits even if more electrically conductive portions are attached. Also, it is not necessary to cut off both lines A and A' but sufficient to cut off only one line. Moreover, a control circuit can be used as outside circuit 53 instead of the circuit for observing with indicator 54.

Figure 10:
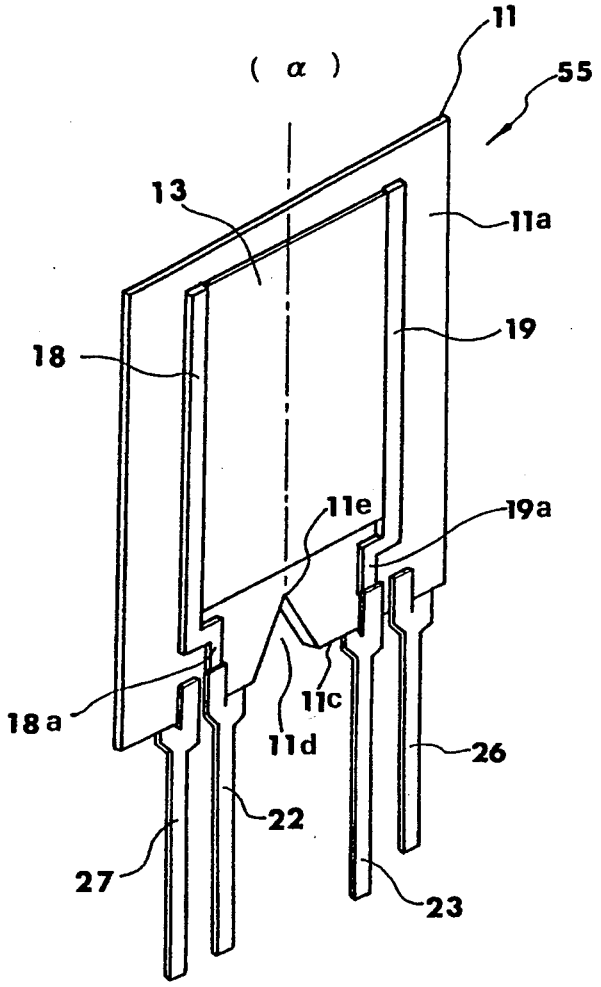
FIG. 10 is a perspective view showing a front side of a fourth circuit opening device.
Figure 11:
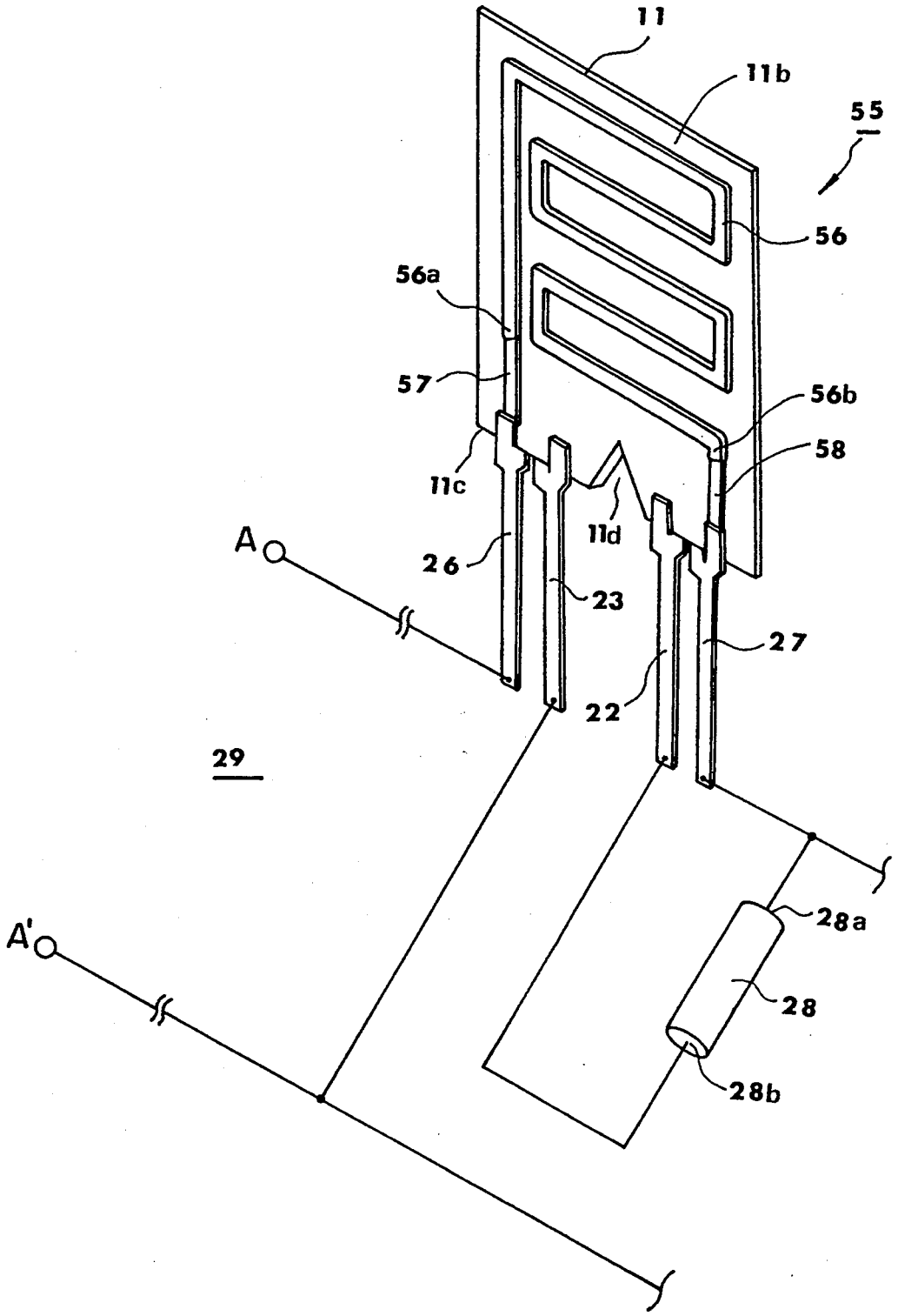
FIG. 11 is a perspective view showing a rear side of the fourth circuit opening device.
Figure 12:
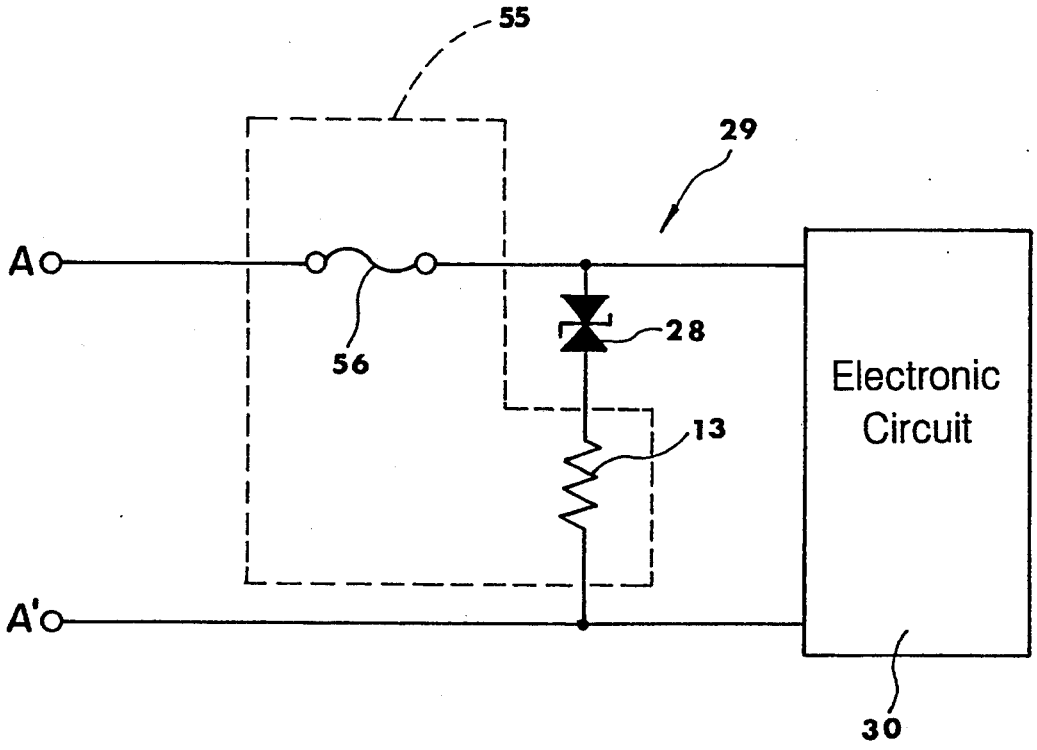
FIG. 12 is a circuit of the fourth circuit opening device.

Referring to FIGS. 10 and 11, and 12, the feature of a fourth circuit opening device is that a first fuse pattern 56 is attached at a rear side 11*b* of first insulating substrate 11. First fuse pattern 56 is made from a low melting point material such as an alloy of a lead and a tin, which is formed by a evaporated film in a zigzag pattern. It is possible to adjust the current carrying limit of fuse pattern 56 by adjustment of the width and the thickness. A lower left end 56*a* of first fuse pattern 56 is connected to first joint pattern 57 connected to third terminal 26. A right end 56*b* of first fuse pattern 56 is connected to second joint pattern 58 connected to fourth terminal 27. Aside from the above, it has the same construction as first circuit opening device 10.

In fourth circuit opening device 55 as shown in FIG. 11, third terminal 26 and fourth terminal 27 are connected to line A. Also, first terminal 22 is connected to a lower end 28*b* of silicon surge absorber 28 whose upper end 28*a* is connected to line A. Second terminal 23 is connected to line A' so that first fuse pattern 56 is connected to line A in series referring to FIG. 12. First heat generating resistant film 13 is connected to silicon surge absorber 28 connected between lines A and A'.

When a continuous overvoltage develops in line A and A', First insulating substrate 11 ruptures causing first heat generating resistant film 13 and first fuse pattern 56 to be physically severed from lines A and A', respectively. Severing resistant film 13 from line A isolates silicon surge absorber 28 from line A'. Isolating surge absorber 28 effectively opens security circuit 29.

Even if an overcurrent, greater than a safe current level for electronic circuit 30, develops in line A and A', first fuse pattern 56 is melted off and then line A is cut off. Therefore, electronic circuit 30 is protected from the overcurrent.

Figure 13:
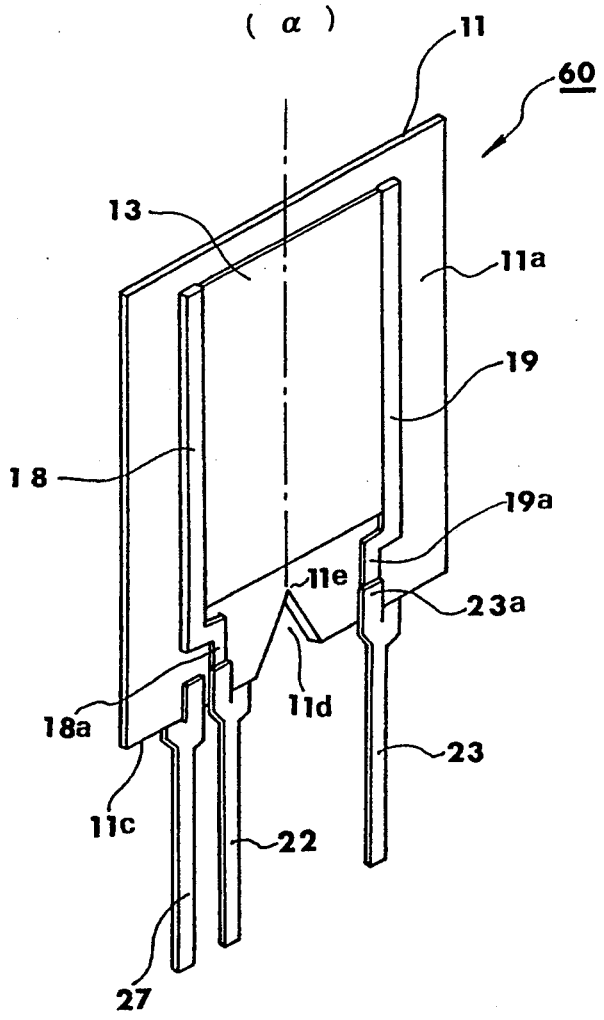
FIG. 13 is a perspective view showing a front side of a fifth circuit opening device.
Figure 14:
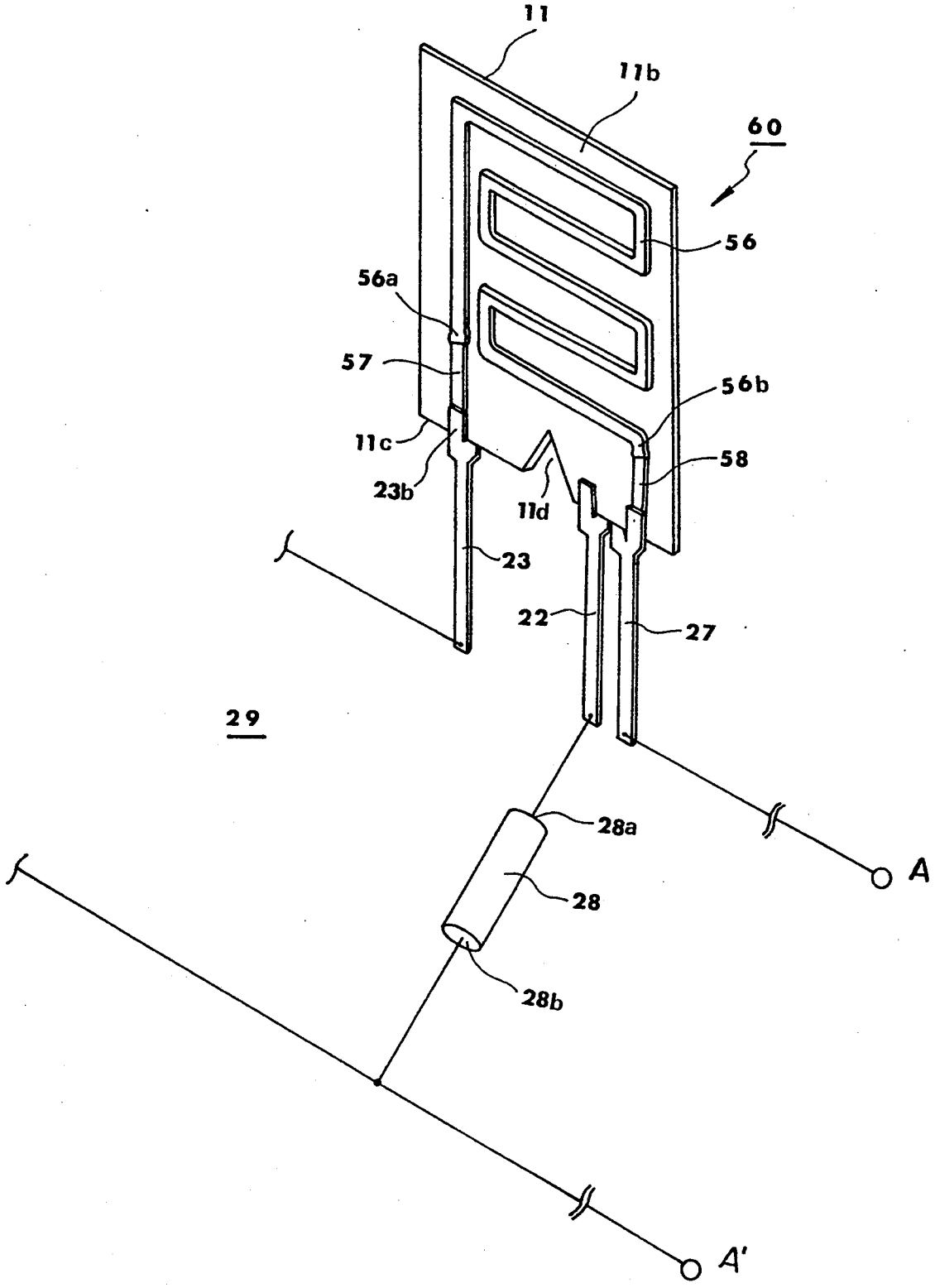
FIG. 14 is a perspective view showing a rear side of the fifth circuit opening device.
Figure 15:
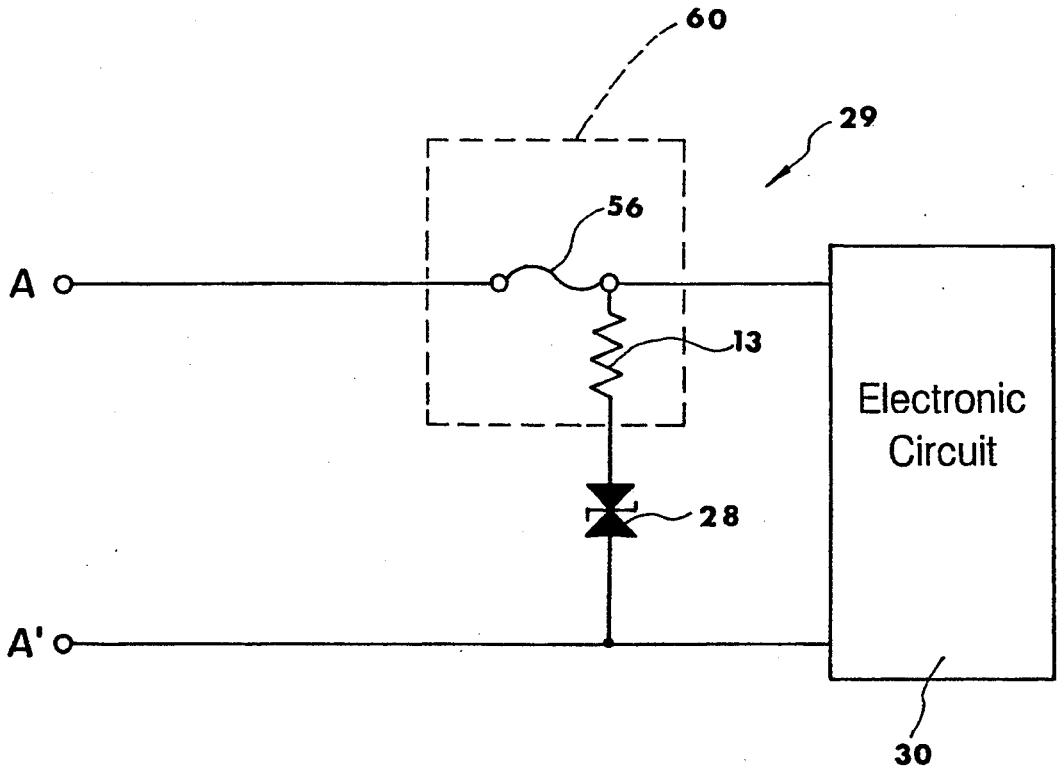
FIG. 15 is a circuit of the fifth circuit opening device.

Referring to FIGS. 13 and 14, and 15, in fifth circuit opening device 60, second terminal 23 also has the function of third terminal 26 of fourth circuit opening device 55. Second terminal connecting portion 19*a* is connected to a branch 23*a* of second terminal 23 attached at a front side 11*a* of first insulating substrate 11, and also second branch 23*b* at a rear side 11*b* is connected to first joint pattern 57.

In fifth circuit opening device 60, second terminal 23 and fourth terminal 27 are connected to line A, and also first terminal 22 is connected to upper end 28*a* of silicon surge absorber 28 whose lower end 28*b* is connected to line A', so that first fuse pattern 56 is connected to line A in series. Also, first heat generating resistant film 13 is connected in series with silicon surge absorber 28 between line A and A' as shown in FIG. 15. Fifth circuit opening device 60 has the same ability to protect against an overvoltage and an overcurrent as that of fourth circuit opening device 55.

Figure 16:
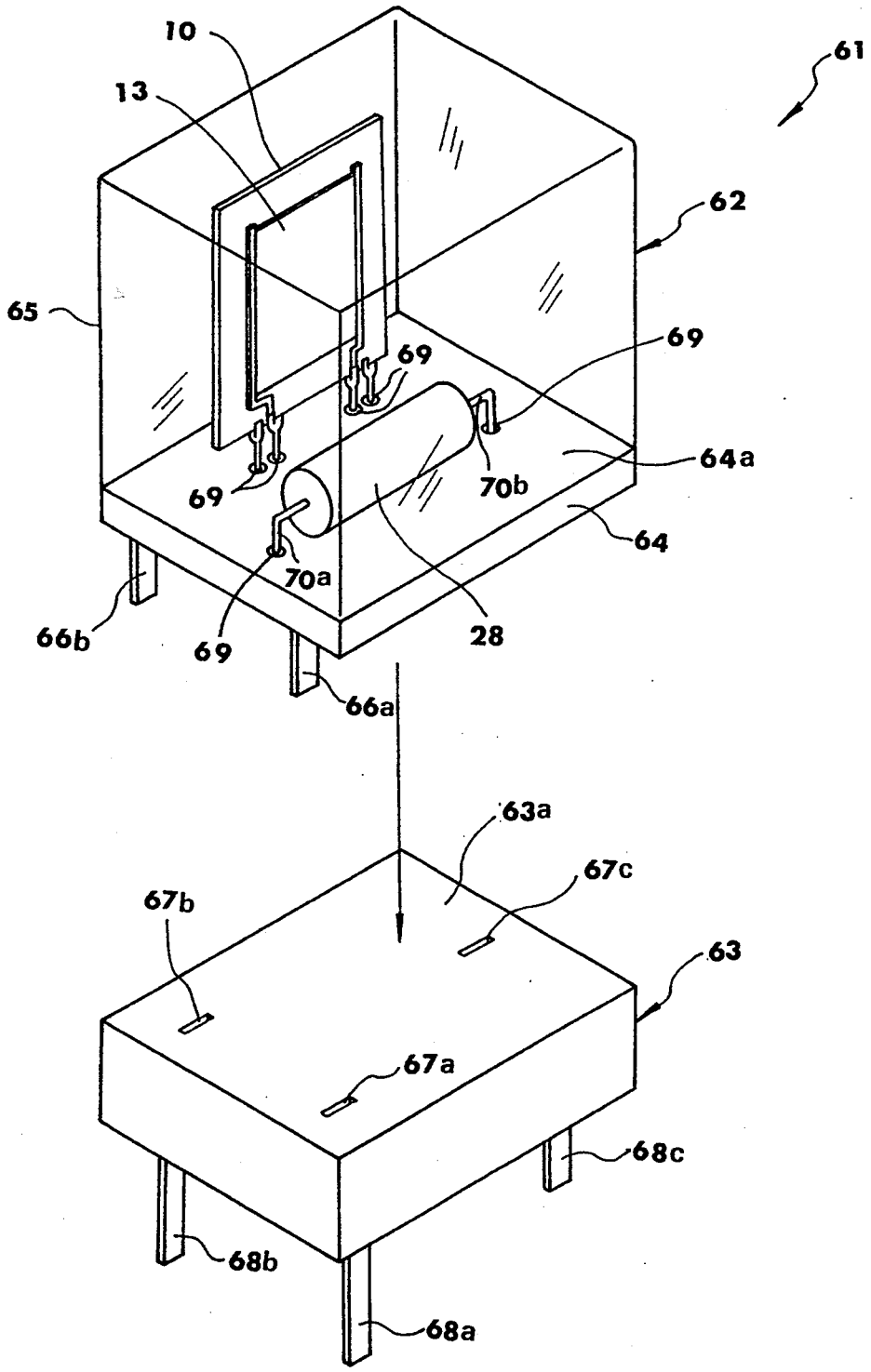
FIG. 16 is an exploded perspective view of a first overvoltage protecting device according to this invention.
Figure 17:
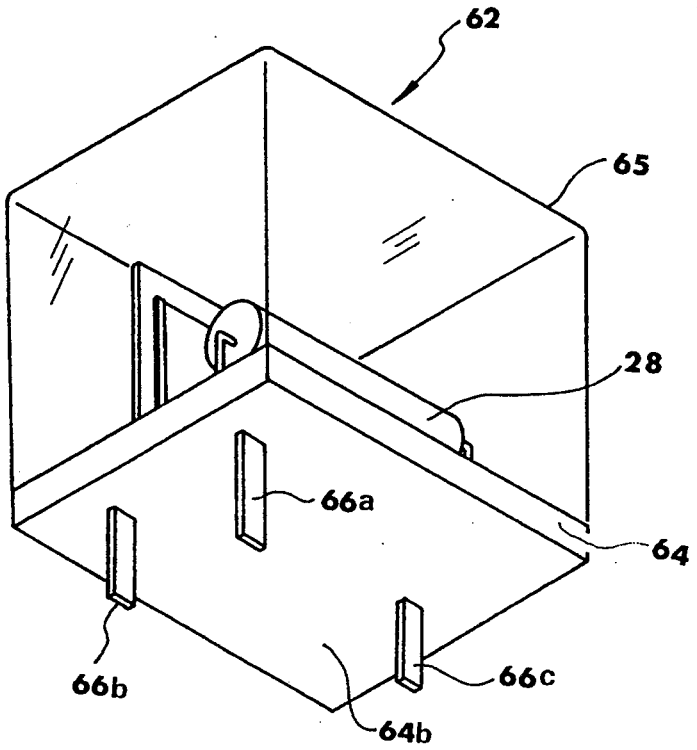
FIG. 17 is a perspective view of a first part of the first overvoltage protecting device.
Figure 18:
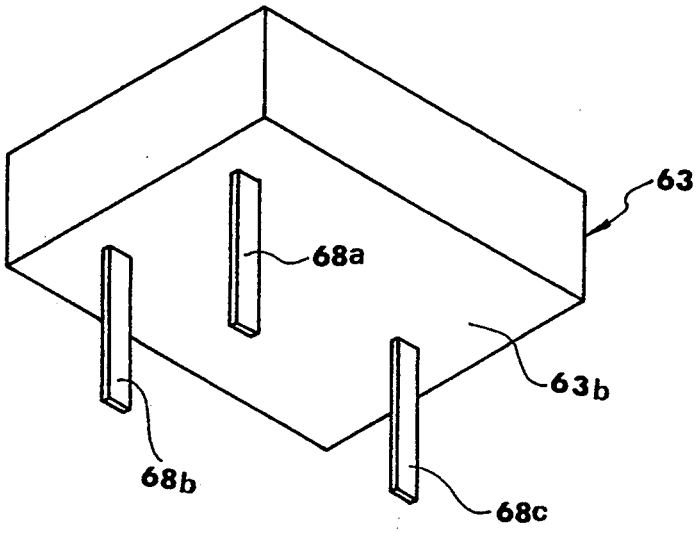
FIG. 18 is a perspective view of a first socket of the first overvoltage protecting device.

Referring to FIG. 16, 17, and 18, first circuit protecting device 61 includes first device component 62 comprising first circuit opening device 10 and silicon surge absorber 28, and first socket 63 to connect with first device component 62. First device component 62 has first base 64, to which first circuit opening device 10 and silicon surge absorber 28 are attached. Also, a surface 64*a* of first base 64 is covered with a cover 65 made of a transparent plastic or the like. First connecting plug 66*a*, second connecting plug 66*b* and third connecting plug 66*c* protrude from a bottom 64*b* of first base 64.

First connecting plug 66*a*, second connecting plug 66*b* and third connecting plug 66*c* connect to a first opening 67*a*, a second opening 67*b* and a third opening 67*c* in a surface 63*a* of first socket 63, respectively. Referring to FIG. 18, first outside terminal 68*a*, second outside terminal 68*b* and third outside terminal 68*c* protrude from a bottom plane 63*b* of first socket 63.

First terminal 22, second terminal 23, third terminal 26, and fourth terminal 27 of first circuit opening device 10 are inserted into first base 64 through guiding openings 69 in first base 64. Also, first connecting terminal 70*a* and second connecting terminal 70*b* of silicon surge absorber 28 are inserted into first base 64 through guiding openings 69.

In first base 64, first connecting plug 66*a* is connected to third terminal 26 of first circuit opening device 10 and then second connecting plug 66*b* is connected to first terminal 22 and fourth terminal 27 of first circuit opening device 10. Also, second terminal 23 of first circuit opening device 10 is connected to first connecting terminal 70*a* of silicon surge absorber 28. Moreover, third connecting plug 66*c* is connected to second connecting terminal 70*b* of silicon surge absorber 28.

First connecting plug 66*a* to third connecting plug 66*c* of first device component 62 are inserted into first opening 67*a* to third opening 67*c* of first socket 63 respectively, thereby first circuit protecting device 61 is formed. By connection of first device component 62 and first socket 63, in first socket 63, first connecting plug 66*a* to third connecting plug 66*c* are connected to first outside terminal 68*a* to third outside terminal 68*c* respectively.

Figure 19:
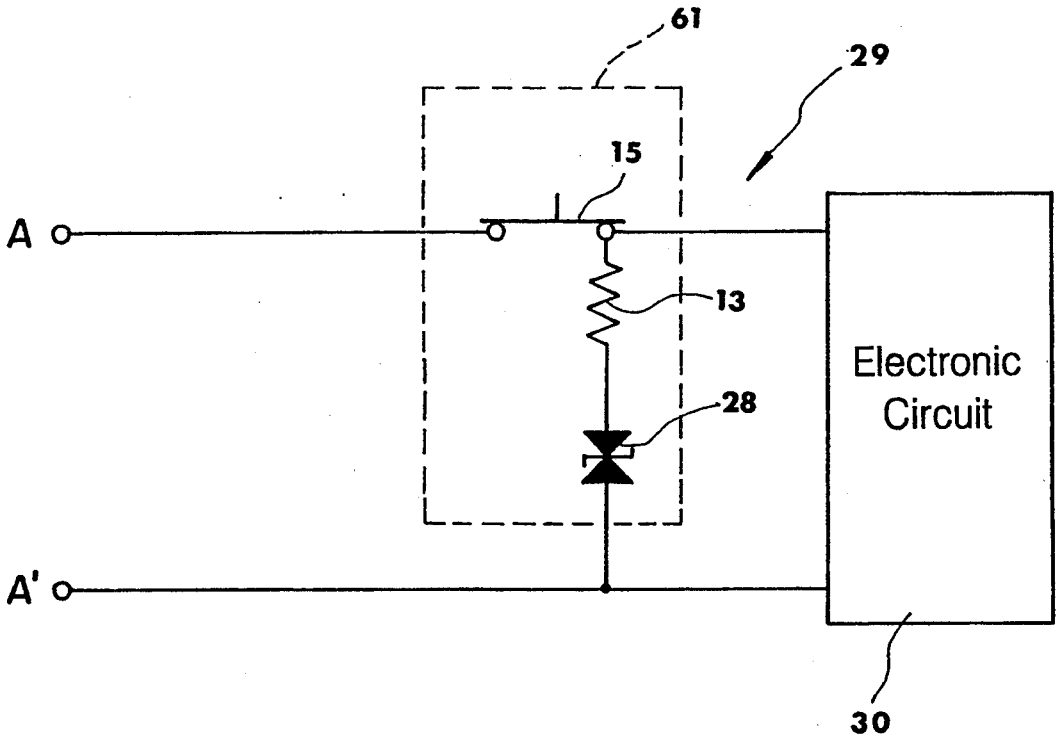
FIG. 19 is a circuit of the first overvoltage protecting device.
Figure 20:
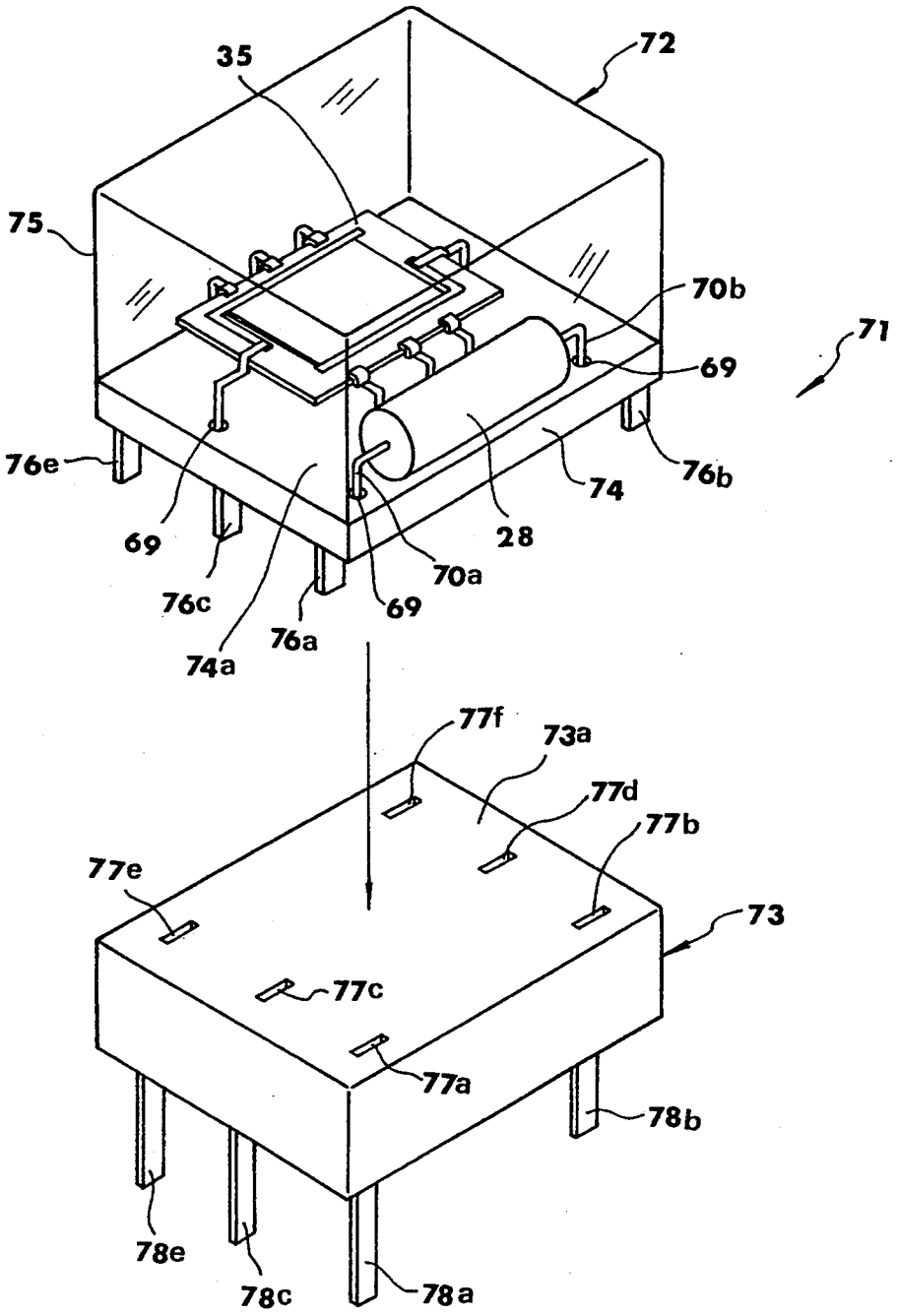
FIG. 20 is an exploded perspective view of a second overvoltage protecting device.
Figure 21:
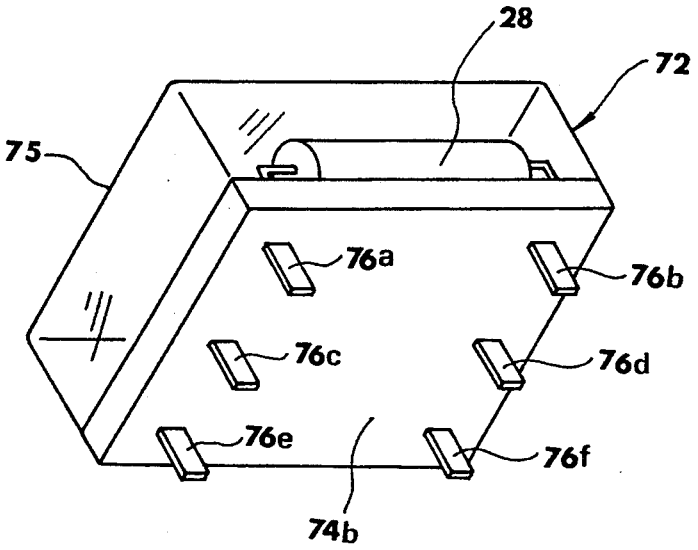
FIG. 21 is a perspective view of a second part of the second overvoltage protecting device.

Referring to FIG. 19, first circuit protecting device 61 is connected between line A and line A'. First outside terminal 68*a* and second outside terminal 68*b* of first socket 63 are connected to line A. Third outside terminal 68*c* is connected to line A', so that first electric conductive film 15 of first circuit opening device 10 is connected to line A in series. First heat generating resistant film 13 is connected to silicon surge absorber 28 in series between line A and line A'. Therefore, security circuit 29 is connected between line A and electronic circuit 30.

When a continuous overvoltage develops in lines A and A', first heat generating resistant film 13 heats by means of an overcurrent from the overvoltage so that first insulating substrate 11 ruptures. First heat generating resistant film 13 and first electric conductive film 15 are separated from lines A' and A, respectively. Silicon surge absorber 28 is isolated from line A. Security circuit 29 is opened simultaneously.

In first circuit protecting device 61, since first device component 62 and first socket 63 are detachably connected to each other, when first circuit opening device 10 ruptures, it is possible to replace only first device component 62. Also, it is easy to attach the device to a circuit by means of an integration of first circuit opening device 10 and silicon surge absorber 28.

Referring to FIGS. 20, 21, 22, and 23, second circuit protecting device 71 has second device component 72 comprising third circuit opening device 35 and silicon surge absorber 28, and second device component 72 detachably connected to second socket 73. Second device component 72 has second base 74. Third circuit opening device 35 and silicon surge absorber 28 are attached to surface 74*a* and covered with a cover 75. Also, in FIG. 21, six connecting plugs 76*a* to 76*f* protrude from a bottom 74*b* of second base 74.

Figure 22:
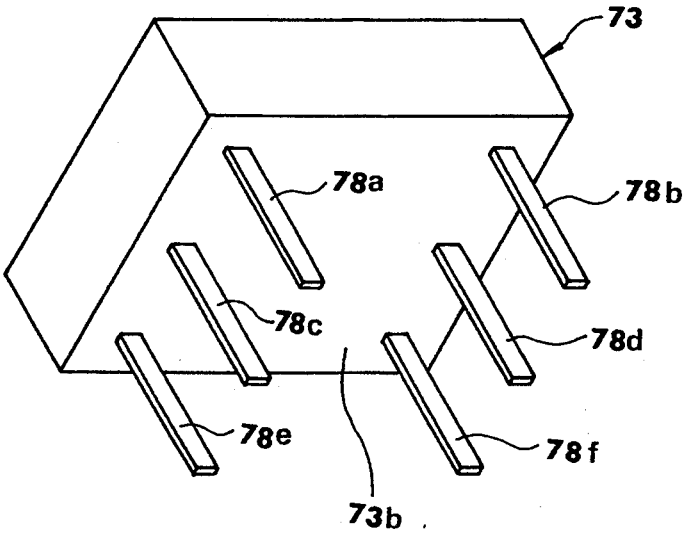
FIG. 22 is a second socket of the second overvoltage protecting device.
Figure 23:
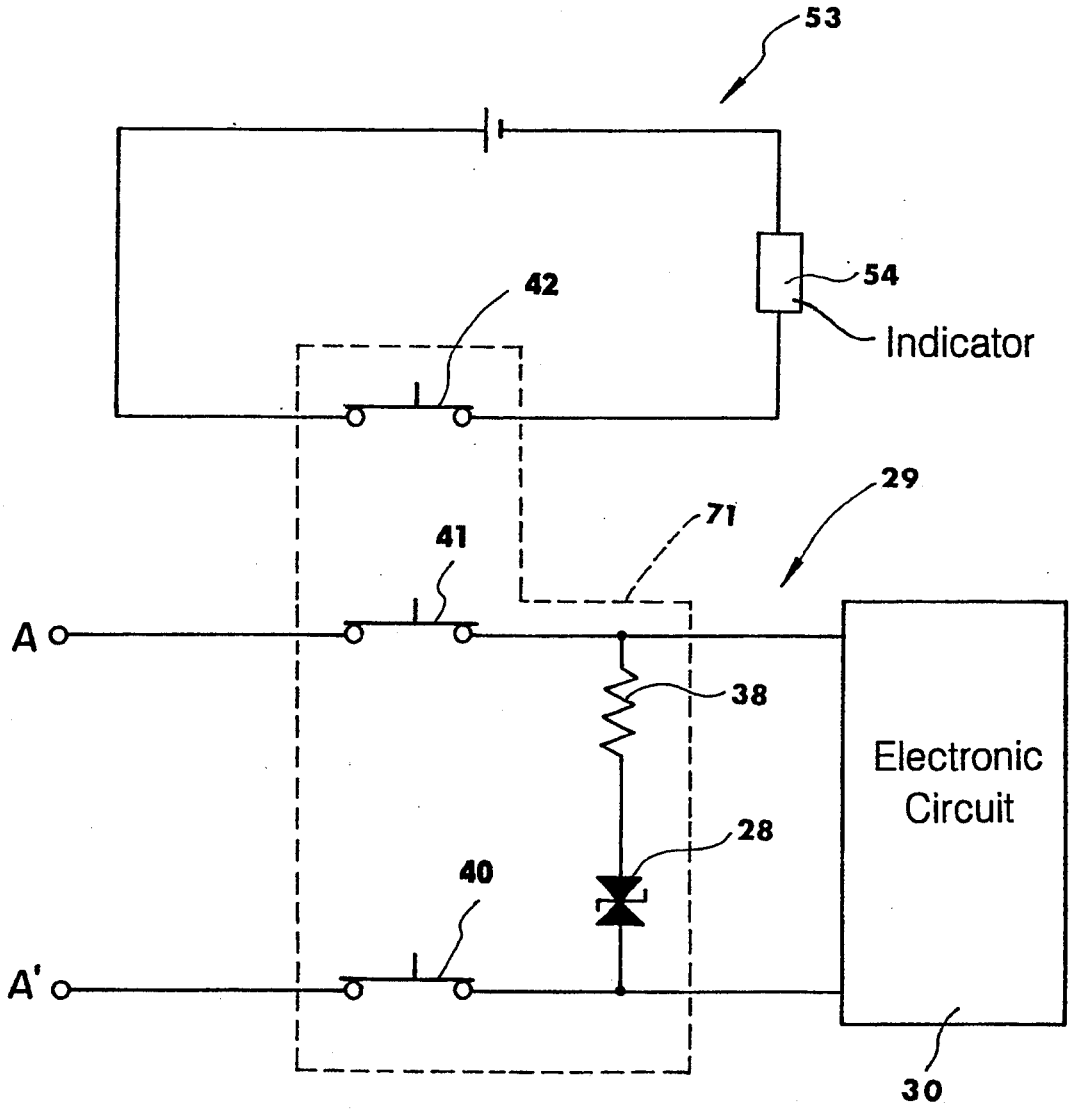
FIG. 23 is a circuit diagram of the second overvoltage protecting device.

Six openings 77*a* to 77*f* in surface 73*a*, of second socket 73, corresponding to the above connecting plugs. Referring to FIG. 22, six outside terminals protrude from a bottom 73*b* of second socket 73.

Eight L type terminals 45 to 52 of third circuit opening device 35 are attached on second base 74 through guiding openings 69 of perforated front plane 74*a*. Also, first connecting terminal 70*a* and second connecting terminal 70*b* of silicon surge absorber 28 are inserted into second base 74 through guiding openings 69.

On second base 74, fourth connecting plug 76*a* and third L type terminal 47 are connected to each other, and also fifth connecting plug 76*b* is connected to fourth L type terminal 48 and first L type terminal 45. Moreover, second L type terminal 46 and first connecting terminal 70*a* of silicon surge absorber 28 are connected each other. Sixth connecting plug 76*c* is connected to fifth L type terminal 49. Seventh connecting plug 76*d* is connected to sixth L type terminal 50 and second connecting terminal 70*b* of silicon surge absorber 28. Eighth connecting plug 76*e* is connected to seventh L type terminal 51. Finally, ninth connecting plug 76*f* is connected to eighth L type terminal 52.

Fourth connecting plug 76*a* through ninth connecting plug 76*f* of second device component 72 are inserted into fourth opening 77*a* through ninth opening 77*f* of second socket 73 respectively. Second device component 72 is detachably coupled to second socket 73. Second circuit protecting device 71 is thus formed. When second device component 72 and second socket 73 are connected with each other, fourth connecting plug 76*a* through ninth connecting plug 76*f* are connected electrically to fourth outside terminal 78*a* through ninth outside terminal 78*f* of second socket 73.

Second circuit protecting device 71 is connected between lines A and A'. Fourth outside terminal 78*a* and fifth outside terminal 78*b* of second socket 73 are connected to line A. Sixth outside terminal 78*c* and seventh outside terminal 78*d* are connected to line A'. As a result of these connections, first electric conductive portion 40 and second electric conductive portion 41 are connected to lines A and A' in series respectively. Also, second heat generating resistant film 38 and silicon surge absorber 28 are connected in series between lines A and A'. Therefore, security circuit 29 can isolate line A from electronic circuit 30. However, Eighth outside terminal 78*e* and ninth outside terminal 78*f* of second socket 73 are not connected to security circuit 29 but to outside circuit 53, so that third electric conductive portion 42 is connected to outside circuit 53 in series.

When a continuous overvoltage occurs in lines A and A' second heat generating resistant film 38 heats due to an overcurrent from the overvoltage so that second insulating substrate 36 ruptures. In addition, silicon surge absorber 28 is separated from line A, and simultaneously security circuit 29 and outside circuit 53 are opened.

Figure 24:
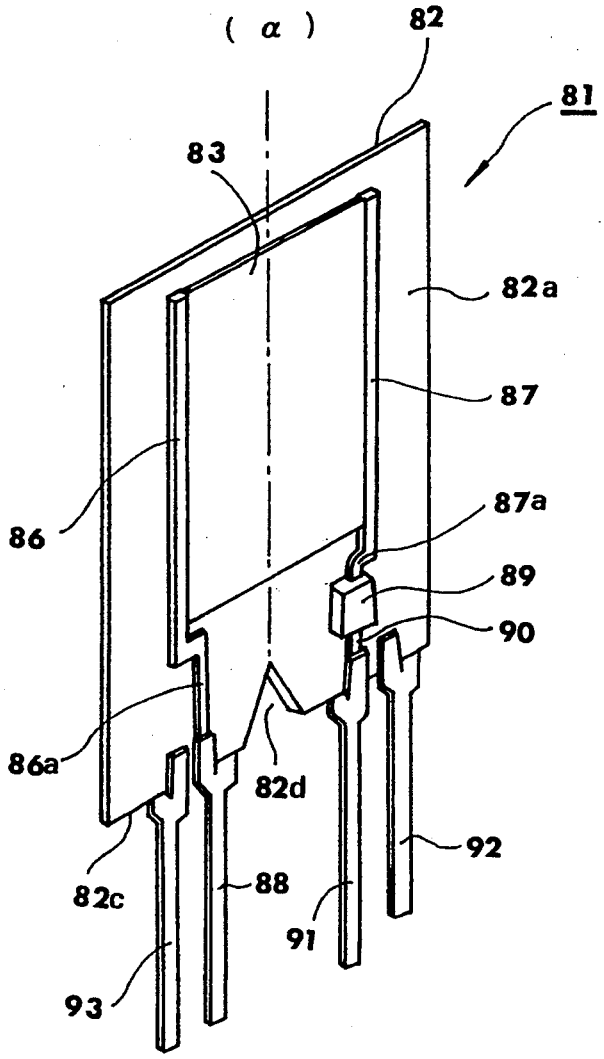
FIG. 24 is a perspective view showing a front side of a third overvoltage protecting device.
Figure 25:
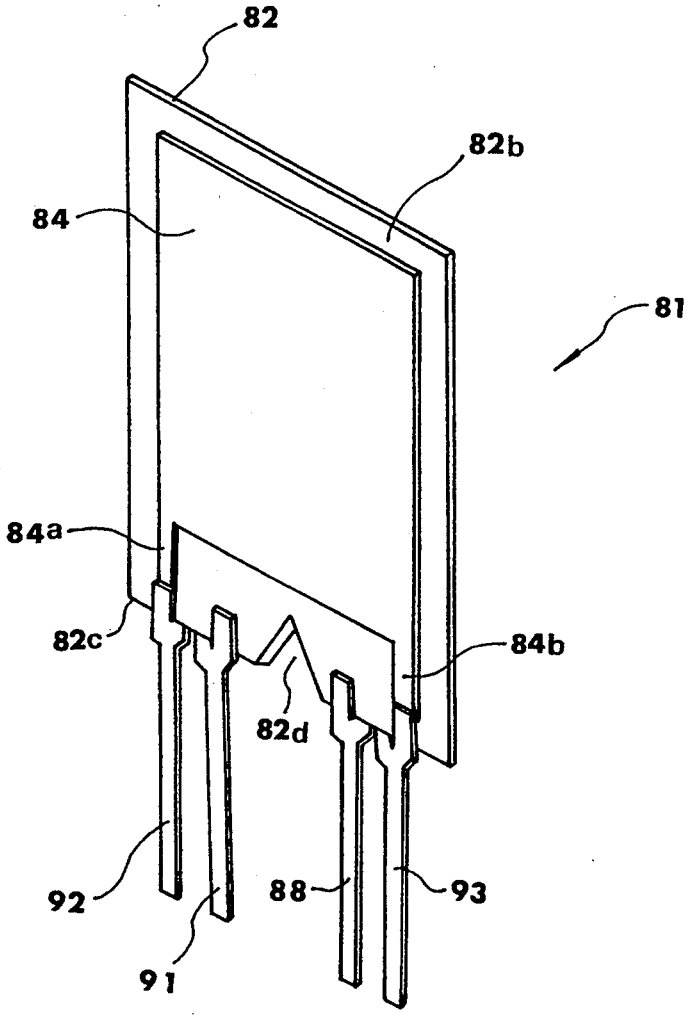
FIG. 25 is a perspective view showing a rear side of the third overvoltage protecting device.
Figure 26:
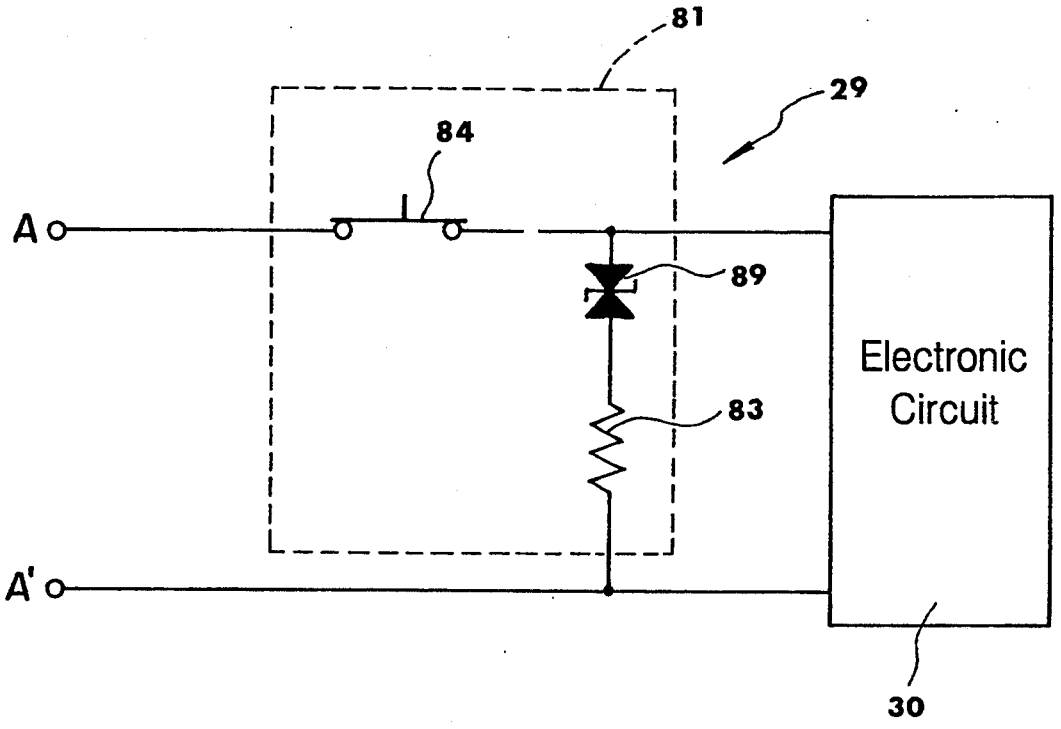
FIG. 26 is a circuit of the third overvoltage protecting device.

Referring to FIGS. 24, 25, and 26, third circuit protecting device 81 has third insulating substrate 82, third heat generating resistant film 83 attached on a front side 82*a* of third insulating substrate 82 and second electric conductive film 84 attached on a rear side 82*b* of third insulating substrate 82. Third insulating substrate 81 made from the same material as that of first insulating substrate 11 has the same thickness. A triangular cutout 82*d* is formed in a center of a lower end 82*c* of third insulating substrate 82. Third heat generating resistant film 83, formed in the same way as first heat generating resistant film 13, has the same thickness. Second electric conductive film 84, formed in the same way as first electric conductive film 15, has the same thickness.

Fifth electrode pattern 86 is formed at the left side of third heat generating resistant film 83 and also sixth electrode pattern 87 is formed at the right side in FIG. 24. At a lower side of fifth electrode pattern 86, there is fifth terminal joint 86*a* to which fifth terminal 88 is connected. An upper end of chip type silicon surge absorber 89 is connected to a lower side 87*a* of sixth electrode pattern 87 and also a lower end of chip type silicon surge absorber 89 is connected to an electric conductive pattern 90 to which sixth terminal 91 is connected. This chip type silicon surge absorber 89 is fixed at a front side 82*a* of third insulating substrate 82.

There is a third extension 84*a* at the left side of second electrically conductive film 84, and also fourth extension 84*b* at the right side. Third extension portion 84*a* and fourth extended portion 84*b* are connected to seventh terminal 92 and eighth terminal 93 respectively, as shown in FIG. 25.

Referring to FIG. 26, seventh terminal 92 and eighth terminal 93 are connected to line A, so that second electrically conductive film 84 is connected to line A in series. Moreover, sixth terminal 91 and fifth terminal 88 are connected to lines A and A', respectively. So that chip type silicon surge absorber 89 and third heat generating resistant film 83 are connected between lines A and A'.

When a continuous overvoltage occurs in lines A and A', an overcurrent from the overvoltage flows through chip type silicon surge absorber 89 so that third heat generating resistant film 83 heats and third insulating substrate 82 ruptures. The rupturing of insulating substrate 82 causes third heat generating resistant film 83 and second electric conductive film 84 to physically separate from input lines A' and A, respectively. The physical separation of film 84 isolates silicon surge absorber 89 from line A'. Isolating silicon surge absorber 89 from line A' opens security circuit 29.

By using chip type silicon surge absorber 89 attached on third insulating substrate 82, it is possible to simplify the structure, make the device compact and easily installable in a circuit.

Figure 27:
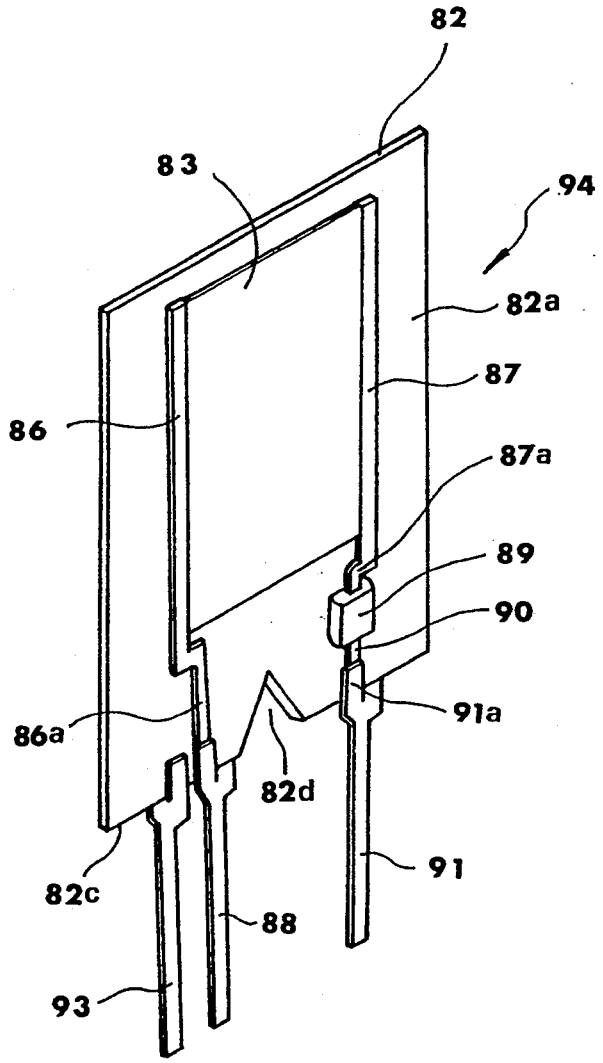
FIG. 27 is a perspective view showing a front side of a fourth overvoltage protecting device.
Figure 28:
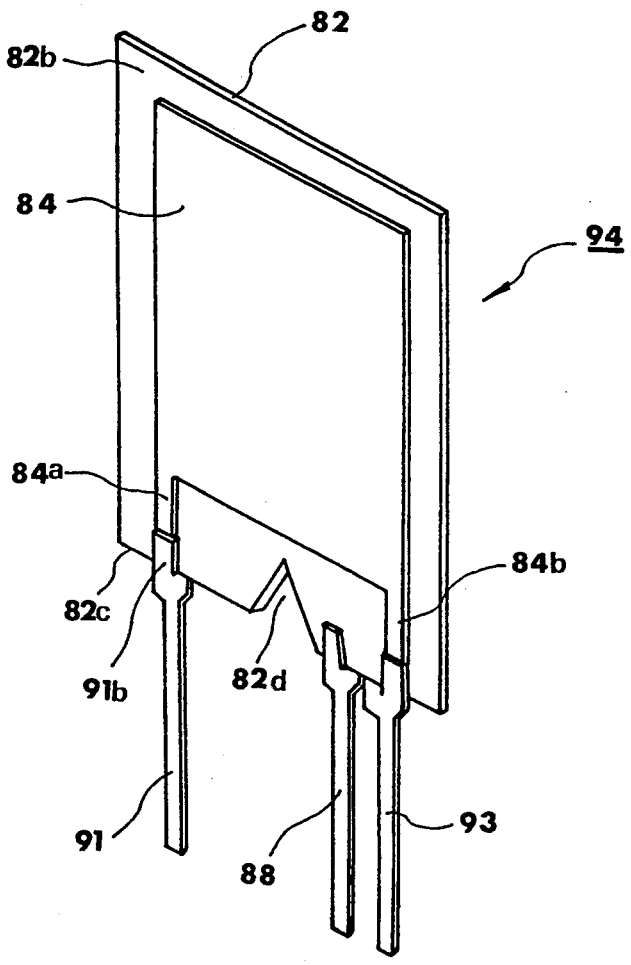
FIG. 28 is a perspective view showing a rear side of the fourth overvoltage protecting device.
Figure 29:
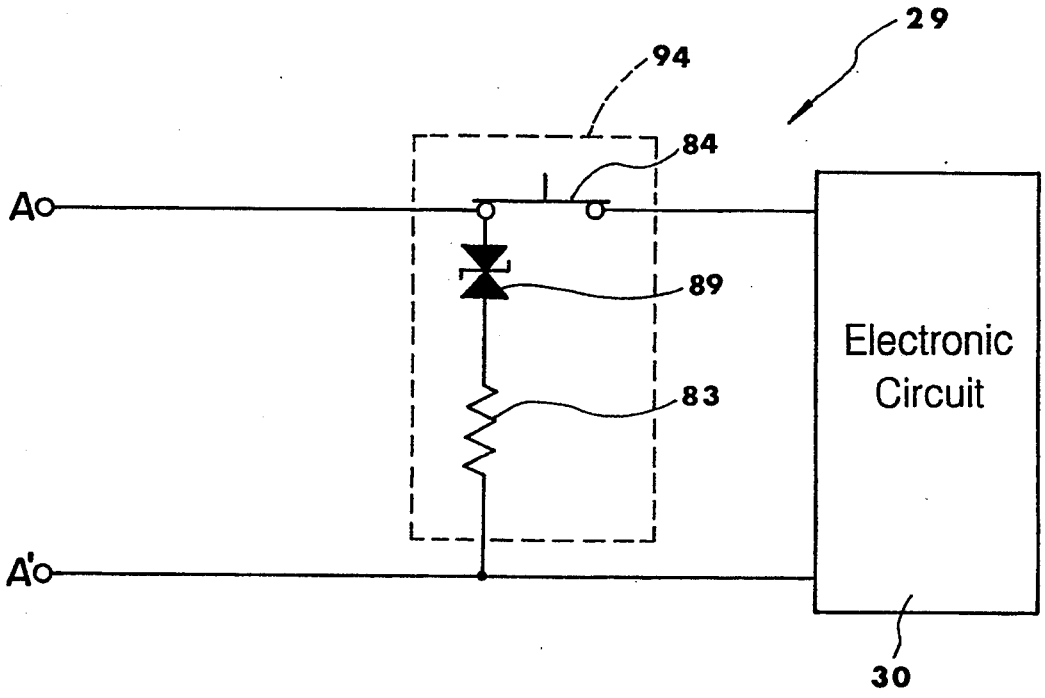
FIG. 29 is a circuit of the fourth overvoltage protecting device.

Fourth circuit protecting device 94 shown in FIGS. 27 and 28, and 29 lacks seventh terminal 92 of third circuit protecting device 81 since sixth terminal 91 has the same function. Electrically conductive pattern 90 is connected to first branch 91*a* of sixth terminal 91 on a front side 82*a* of third insulating substrate 82, and also second branch 91*b* of a rear side 82*b* is connected to third extension 84*a*.

Fourth circuit protecting device 94 is connected between line A and A' as shown in FIG. 29. Sixth terminal 91 and eighth terminal 93 are connected to line A, so that second electrically conductive film 84 is connected to line A in series. Chip type silicon surge absorber 89 and third heat generating resistant film 83 are connected in series between line A and A' as a result of fifth terminal 88 being; connected to line A'. Fourth circuit protecting device 94 prevents the destruction by a surge as well as third circuit protecting device 81.

Figure 30:
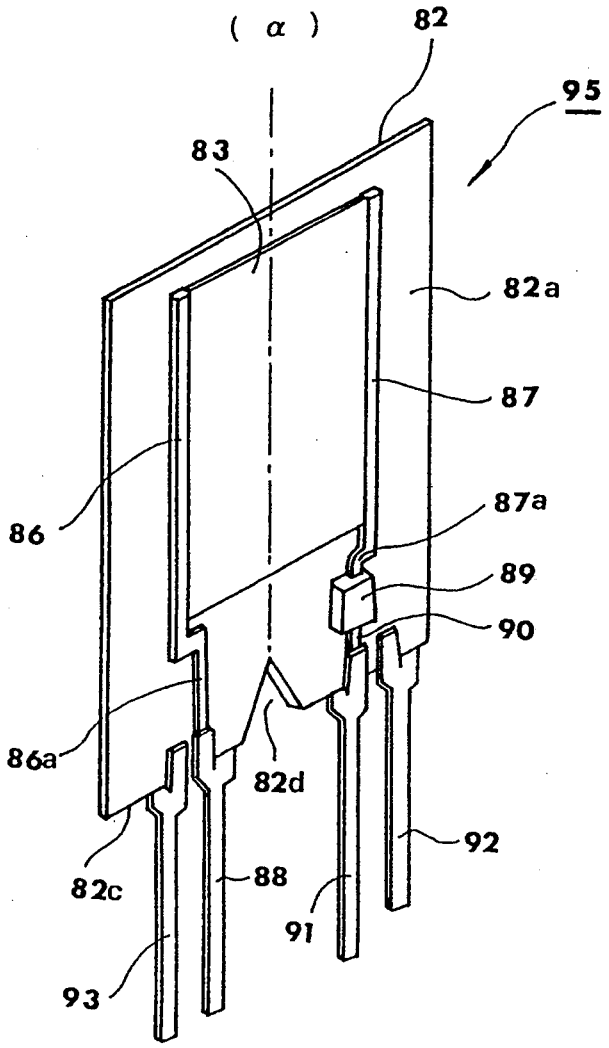
FIG. 30 is a perspective view showing a front side of a fifth overvoltage protecting device.
Figure 31:
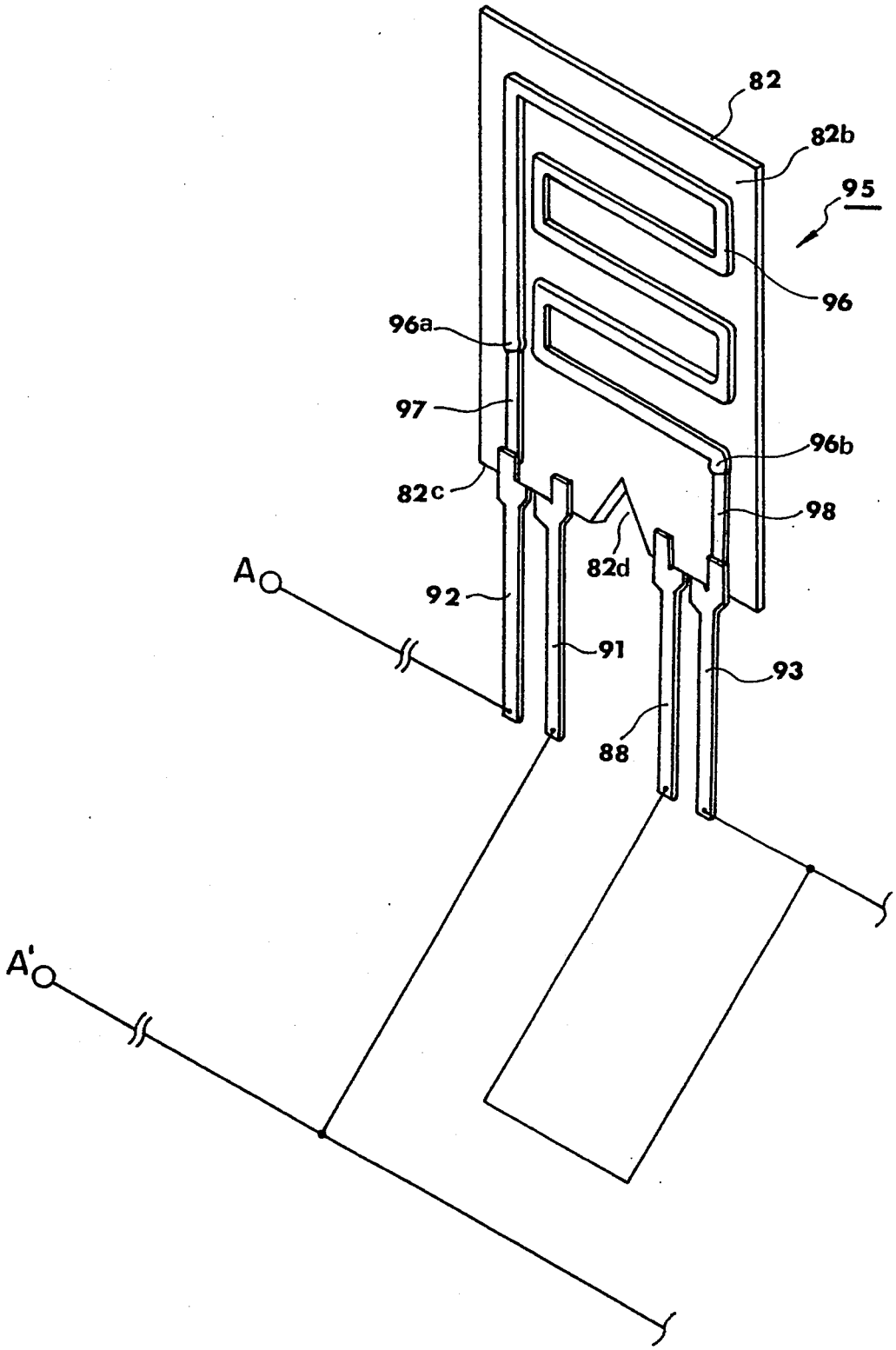
FIG. 31 is a perspective view showing a rear side of the fifth overvoltage protecting device.

Referring to FIGS. 30 and 31, fifth circuit protecting device 95 lacks second electrically conductive film 84 of third circuit protecting device 81. Instead of it, second fuse pattern 96 is attached on a rear side 82*b* of third insulating substrate 82. Seventh terminal 92 is connected to second fuse pattern 97. Fourth connecting pattern 98 connected to eighth terminal 93 is connected at the left bottom 96*b* of second fuse pattern 96. The other structure is the same as that of third circuit protecting device 81.

Seventh terminal 92, eighth terminal 93 and fifth terminal 88 of fifth circuit protecting device 95 are connected to line A and sixth terminal 91 is connected to line A'. Thus, second fuse pattern 96 is connected to line A in series. Second heat generating resistant film 83 and chip type silicon surge absorber 89 connected in series between lines A and A'.

When a continuous overvoltage occurs in lines. A and A', an overcurrent from the overvoltage flows through chip type silicon surge absorber 89 so that third heat generating resistant film 83 heats and third insulating substrate 82 ruptures. As a result, third heat generating resistant film 83 and second fuse pattern 96 are cut off so that chip type silicon surge absorber 89 is separated from line A'. Therefore, security circuit 29 is opened due to line A opening. Also, when an overcurrent occurs in line A and A', independent of the rupture of third insulating substrate 82, second fuse pattern 96 melts due to the surge so that line A is cut off.

Figure 32:
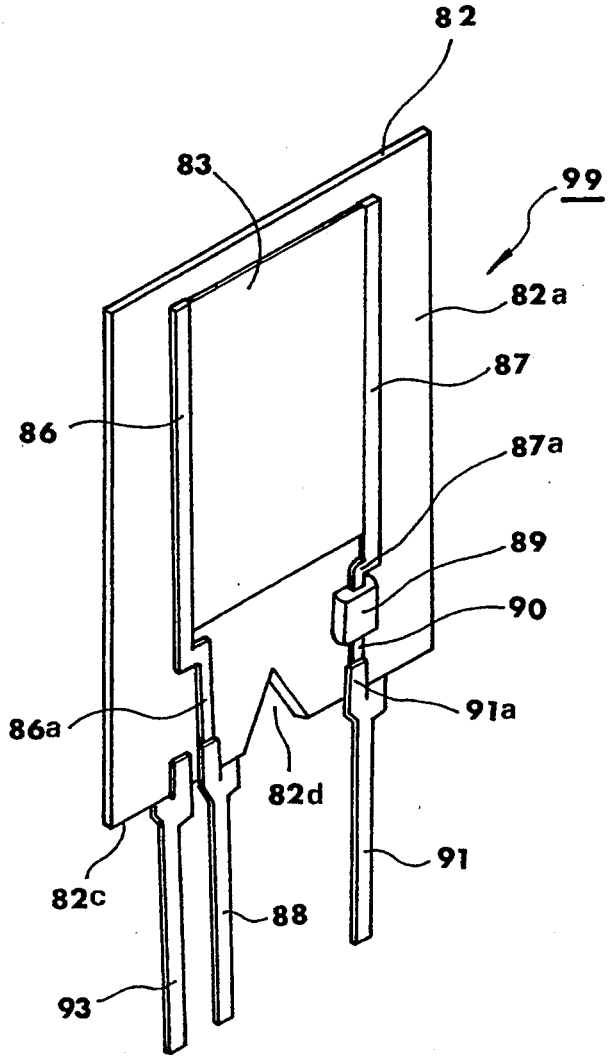
FIG. 32 is a perspective view showing a front side of a sixth overvoltage protecting device.
Figure 33:
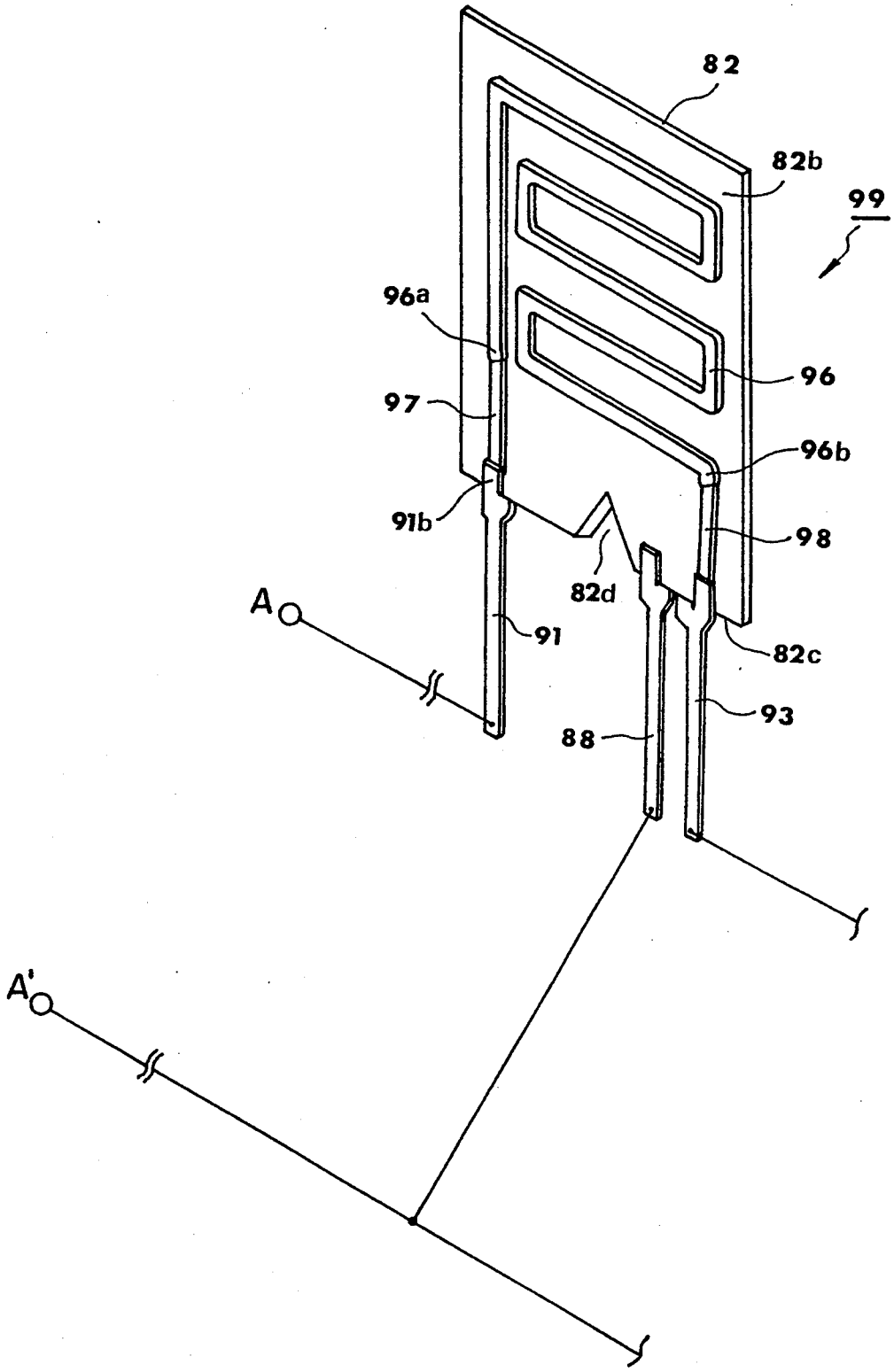
FIG. 33 is a perspective view showing a rear side of the sixth overvoltage protecting device.
Figure 34:
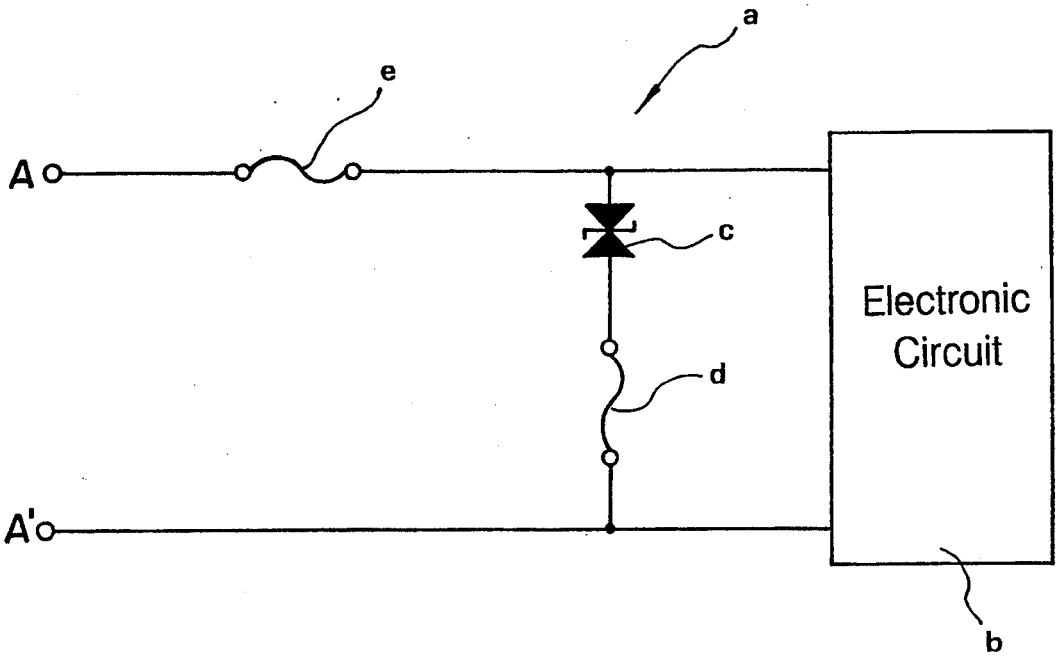
Fig. 34 PRIOR ART
FIG. 34 is a conventional circuit.

Referring to FIGS. 32 and 33, in sixth circuit protecting device 99, sixth terminal 91 has the same function as that of seventh terminal 92 of fifth circuit protecting device 95. Namely, electric conductive pattern 90 is connected to first branch 91*a* of sixth terminal 91 on a front side 82*a* of third insulating substrate 82, and also second branch 91*b* on a rear side 82*b* is connected to third connecting pattern 97.

Sixth terminal 91 and eighth terminal 93 of sixth circuit protecting device 99 are connected to line A as shown in FIG. 33 and fifth terminal 88 is connected to line A'. Therefore, second fuse pattern 96 is connected to line A in series. Chip type silicon surge absorber 89 and third heat generating resistant film 83 are connected in series between lines A and A'. Sixth circuit protecting device 99 also prevents the destruction of a load surge as well as fifth circuit protecting device 95.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A device for protecting a circuit comprising:

a device component;

said device component having a device for opening a circuit, a rated voltage element and a plurality of connecting plugs;

a socket;

said socket having a plurality of openings and a plurality of outside terminals;

said device for opening said circuit having a heat generating resistant body and an electric conductive body attached on an insulating substrate;

said rated voltage element connected in series to said heat generating resistant body;

two lines;

said two lines constructed for power resource or communication;

said plurality of openings corresponding to said plurality of connecting plugs;

said plurality of outside terminals being integral with said plurality of openings;

said device component attachably mounted on said socket so that said plurality of connecting plugs are inserted into said plurality of openings;

said device for opening said circuit connected to said two lines through said plurality of connecting plugs, said plurality of openings and said plurality of outside terminals;

said rated voltage element and said heat generating resistant body connected in series between said two lines through said plurality of connecting plugs, said plurality of openings and said plurality of outside terminals;

said electric conductive body connected in series to said two lines through said plurality of connecting plugs, said plurality of openings and said plurality of outside terminals;

said device for opening said circuit including means for disconnecting said circuit from said two lines when an overvoltage greater than a rated voltage of said rated voltage element occurs in said two lines;

said means for disconnecting being responsive to heating by said heat generating resistant body, said heating being caused by an overcurrent from said overvoltage; and said means for disconnecting including means for rupturing said substrate upon said heating.

2. The device for protecting the circuit recited in claim 1, wherein:

said rated voltage element includes a silicon surge absorber.

3. The device for protecting the circuit recited in claim 1, wherein;

said electric conductive body is formed of a fusible material which melts when a current exceeding a specified level flows in said two electrical lines.

4. A device for protecting a circuit comprising:

a device component;

said device component having a device for opening said circuit, a rated voltage element and a plurality of connecting plugs;

a socket;

said socket having a plurality of openings and a plurality of outside terminals;

said device for opening said circuit having a heat generating resistant body and a plurality of electric conductive bodies attached on an insulating substrate;

said rated voltage element connected in series to said heat generating resistant body;

two lines constructed for power resource or communication;

said plurality of openings corresponding to said plurality of connecting plugs;

said plurality of outside terminals integral with said plurality of openings;

said device component attachably mounted on said socket so that said plurality of connecting plugs are inserted into said plurality of openings;

said device for opening said circuit connected to said two lines through said plurality of connecting plugs, said plurality of openings and said plurality of outside terminals;

said rated voltage element and said electric conductive body connected in series between said two lines through said plurality of connecting plugs, said plurality of openings and said plurality of outside terminals;

at least one electric conductive body connected in series to said two lines through said plurality of connecting plugs, said plurality of openings and said plurality of outside terminals;

at least another electric conductive body connected in series to an outside circuit through said plurality of connecting plugs, said plurality of openings and said plurality of outside terminals;

said device for opening said circuit including means for disconnecting said circuit from said two lines when an overvoltage greater than a rated voltage of said rated voltage element occurs in said two lines;

said means for disconnecting being responsive to heating by said heat generating resistant body, said heating being caused by an overcurrent from said overvoltage; and said means for disconnecting including means for rupturing said substrate upon said heating.

5. The device for protecting the circuit recited in claim 4, wherein:

said rated voltage element includes a silicon surge absorber.

6. The device for protecting the circuit recited in claim 4, wherein:

said plurality of electric conductive bodies are made of a fusible material which melts when a current exceeding a specified level flows in said two electrical lines.

* * * * *